US005664024A

United States Patent [19]

Furuta et al.

[11] Patent Number: 5,664,024

[45] Date of Patent: Sep. 2, 1997

[54] LOUDSPEAKER

[75] Inventors: Akihiro Furuta, Takatsuki; Kazue Satoh, Neyagawa; Hiroyuki Takewa, Kaizuka; Mikio Iwasa, Katano; Shinya Mizone, Tsu; Kuniaki Sakai, Matsusaka, all of Japan

[73] Assignee: Matsushita Electric Industrial Co., Ltd., Kadoma, Japan

[21] Appl. No.: 426,707

[22] Filed: Apr. 24, 1995

[30] Foreign Application Priority Data

| | | | |
|---|---|---|---|
| Apr. 25, 1994 | [JP] | Japan | 6-110340 |
| Jan. 30, 1995 | [JP] | Japan | 7-012601 |
| Mar. 22, 1995 | [JP] | Japan | 7-062719 |

[51] Int. Cl.[6] ..... H04R 25/00

[52] U.S. Cl. ..... 381/199; 381/192; 381/197

[58] Field of Search ..... 381/182, 186, 381/188, 192, 193, 194, 195, 196, 197, 199, 201, 202, 203, 204; 181/157, 166, 171, 172; 335/222

[56] References Cited

U.S. PATENT DOCUMENTS

| | | | |
|---|---|---|---|
| 1,846,351 | 2/1932 | Murkham et al. | 381/197 |
| 2,105,934 | 1/1938 | Stevens | 381/197 |
| 3,134,057 | 5/1964 | Tsunoo et al. | 381/199 |
| 3,496,307 | 2/1970 | Sotome | 181/166 |
| 3,873,784 | 3/1975 | Doschek | 179/115.5 PV |
| 3,935,400 | 1/1976 | Koga | 179/115.5 R |
| 4,334,127 | 6/1982 | Shimada et al. | 170/115.5 R |
| 4,492,827 | 1/1985 | Shintaku | 381/199 |

FOREIGN PATENT DOCUMENTS

| | | | |
|---|---|---|---|
| 3331657 | 3/1985 | Germany . | |
| 0101196 | 5/1986 | Japan | 381/199 |
| 0193599 | 8/1986 | Japan | 381/199 |
| 2127650 | 4/1984 | United Kingdom . | |
| 2138648 | 10/1984 | United Kingdom . | |

OTHER PUBLICATIONS

Search Report for European Appl. 95106124.1, mailed Jul. 27, 1995.

*Primary Examiner*—Huyen D. Le
*Attorney, Agent, or Firm*—Renner, Otto, Boisselle & Sklar

[57] ABSTRACT

The loudspeaker of the invention includes: a frame; a diaphragm, a planar shape thereof being non-axisymmetric having a larger diameter and a smaller diameter when the diaphragm is viewed from a vibration direction thereof; a band-shaped edge portion provided around an outer periphery of the diaphragm, an outer periphery of the edge portion being connected to the frame and an inner periphery of the edge portion being connected to the diaphragm; a cylindrical voice coil bobbin in a non-axisymmetric shape having a larger diameter and a smaller diameter which includes a pair of opposed faces parallel to each other in a larger diameter direction, one end portion of the voice coil bobbin being connected to the diaphragm; a voice coil wound around the voice coil bobbin; a plurality of voice coil bobbin reinforcing members in a plate shape which are bridged between the pair of opposed faces parallel to each other of the voice coil bobbin; and a plurality of magnetic circuits having a gap for applying magnetic fluxes to at least a part of the voice coil.

19 Claims, 22 Drawing Sheets

1
2
3
4
5
6
7
8
9
10 a
A
B
b
1
2
3
4
5
6b
7
8b
9b
14
15

LOUDSPEAKER

BACKGROUND OF THE INVENTION

1. Field of the Invention

The present invention relates to a loudspeaker. More specifically, the invention relates to a loudspeaker having an elongate structure including a diaphragm of a small width.

2. Description of the Related Art

Conventionally, it is most common to form loudspeakers in a round shape. However, in recent years, loudspeakers having an elongate structure have increasingly been demanded. Such loudspeakers having an elongate structure are widely used for television sets, for example. Lately, the sound to be reproduced by loudspeakers provided for a television set is frequently received in stereophonic sound, not in monaural sound. Accordingly, in many cases, loudspeakers to be provided for such a television set are now disposed on right and left sides of the Braun tube thereof. In such a case, it is preferable to provide loudspeakers of a small width, i.e., having an elongate structure (hereinafter, referred to as "slim loudspeakers") for a television set so that the lateral width of the television set becomes as small as possible.

The voice coil bobbin of a conventional loudspeaker having an elongate structure is generally of a round shape. Such a voice coil bobbin in a round shape is attached to the center portion of an elliptical, oval or oblong cone-shaped diaphragm so as to drive the cone-shaped diaphragm. The voice coil bobbin is further supported by a round or elliptical damper (hereinafter, a loudspeaker having such a structure will be called "a cone-shaped slim loudspeaker"). A cone-shaped slim loudspeaker of this type has the following problems.

In general, it is difficult for a cone-shaped slim loudspeaker to reproduce sound in a low frequency band because of the following reasons. In a cone-shaped slim loudspeaker, the diameter of a damper is required to be small. If the diameter of a damper is small, then the rigidity thereof becomes large. As a result, the lowest resonance frequency $f_0$ of a loudspeaker becomes high, and therefore the frequency characteristics in a bass sound region are degraded.

A large input can not be applied to a cone-shaped slim loudspeaker. In general, as an input to be applied to a loudspeaker becomes larger, the amplitude of a diaphragm also becomes larger. Since the diameter of a damper of a cone-shaped slim loudspeaker is much smaller than the larger diameter of a diaphragm, a rolling is likely to occur particularly about a larger diameter direction when the amplitude of a diaphragm is large. In the case where a diaphragm rolls in the larger diameter direction, the voice coil sometimes comes into contact with a magnetic circuit depending on the degree of the rolling. Such contact causes abnormal sound, and, in some cases, damages the loudspeaker.

In a cone-shaped slim loudspeaker, large peaks and dips are generated in the relationship between the frequency and the reproduced sound pressure level. Such phenomenon causes undesirable sound quality. The peaks and dips are generated because a higher harmonic resonance is more likely to occur in the larger diameter direction in an elliptical or oval cone-shaped diaphragm as compared with a round diaphragm. The generation of the "higher harmonic resonance" means that the nodes of the vibration of a diaphragm exist at the positions other than the peripheral portion of the diaphragm, that is to say, the resonance is generated in a plurality of regions of a single diaphragm. Accordingly, the resonance frequency when the higher harmonic resonance is generated is higher than the resonance frequency when the higher harmonic resonance is not generated.

The reproduction frequency bandwidth tends to be small in a cone-shaped slim loudspeaker, so that the reproduced sound quality, i.e., the frequency characteristic when the sound is reproduced, becomes degraded. In general, in a cone-shaped loudspeaker, if the reproduction frequency becomes higher than a frequency $f_h$ at a predetermined level, the driving force by a voice coil bobbin is no longer transmitted to the entire portion of the cone-shaped diaphragm. As a result, the reproduced sound pressure level is drastically reduced. The larger the ratio of a larger diameter to a smaller diameter (hereinafter, simply referred to as a "larger/smaller diameter ratio") of a diaphragm of a loudspeaker becomes, the lower this frequency $f_h$ becomes. Since the diaphragm of a cone-shaped slim loudspeaker has a large larger/smaller diameter ratio, the frequency $f_h$ is low. In other words, the reproduction characteristics in a high frequency band are not satisfactory, so that the reproduction frequency bandwidth thereof becomes small.

On the other hand, a dome-shaped loudspeaker, i.e., a loudspeaker having a different structure from that of the above-described loudspeaker, is described in U.S. Pat. No. 3,935,400, for example. As disclosed in the patent, such a dome-shaped loudspeaker has an advantage in that the loudspeaker may improve the frequency characteristics up to a high sound region. However, the loudspeaker has the following problems.

A large input cannot be applied to a dome-shaped loudspeaker in a low sound region where the amplitude of a diaphragm becomes large. Since the dome-shaped loudspeaker is supported only by an edge portion, a rolling is likely to occur particularly about a larger diameter direction when the amplitude of a diaphragm becomes large. As a result, the voice coil may possibly come into contact with a magnetic circuit.

In the case where the larger/smaller diameter ratio of the diaphragm is set to be large while still using the structure of a dome-shaped loudspeaker, parallel linear portions of a voice coil become longer. In such a case, at certain frequencies (or resonance frequencies), resonance is generated in the linear portions of the voice coil bobbin, so that the linear portions vibrate in a direction vertical to the vibration direction of a diaphragm (i.e., the direction of magnetic fluxes within an air gap of a magnetic circuit for driving the voice coil bobbin). The longer the linear portions become, the lower the resonance frequency becomes. The amplitude of the resonance increases as the resonance frequency becomes lower. Accordingly, as the larger/smaller diameter ratio of the diaphragm becomes larger, the resonance amplitude of the voice coil bobbin becomes larger. Consequently, if a larger input is applied to a loudspeaker, this resonance amplitude also becomes larger, so that the voice coil may possibly come into contact with the magnetic circuit.

SUMMARY OF THE INVENTION

The loudspeaker of the invention includes: a frame; a diaphragm, a planar shape thereof being non-axisymmetric having a larger diameter and a smaller diameter when the diaphragm is viewed from a vibration direction thereof; a band-shaped edge portion provided around an outer periphery of the diaphragm, the outer periphery of the edge portion being connected to the frame and an inner periphery of the edge portion being connected to the diaphragm; a cylindrical voice coil bobbin in a non-axisymmetric shape having a larger diameter and a smaller diameter which includes a pair of opposed faces parallel to each other in a larger diameter direction, one end portion of the voice coil bobbin being connected to the diaphragm; a voice coil wound around the voice coil bobbin; a plurality of voice coil bobbin reinforcing members in a plate shape which are bridged between the pair of opposed faces parallel to each other of the voice coil bobbin; and a plurality of magnetic circuits having a gap for applying magnetic fluxes to at least a part of the voice coil.

In one embodiment, each of the plurality of magnetic circuits includes: a yoke having a U-shaped cross section; a first magnet fixed inside the yoke; a plate which is fixed on an upper surface of the first magnet and is opposed to internal side faces of the yoke via gaps; and a second magnet fixed on an upper surface of the plate. A magnetization direction of the first magnet is opposite to a magnetization direction of the second magnet.

In another embodiment, each of the plurality of magnetic circuits includes a pair of yokes, each of the yokes having a U-shaped cross section; each of the pair of yokes includes a magnet fixed on an internal face thereof; and a gap is provided between the pair of yokes.

In still another embodiment, the diaphragm is projected towards a sound radiating direction of the loudspeaker and includes a plurality of reinforcing members connected to an internal face of the diaphragm.

In still another embodiment, a number of the reinforcing members is at least three and the reinforcing members are disposed in the larger diameter direction of the diaphragm so as to be separated at unequal intervals.

In still another embodiment, a width of curvilinear portions of the edge portion is larger than a width of linear portions of the edge portion.

In still another embodiment, the loudspeaker further includes: a diaphragm/elastic member connecting member provided on a sound radiating side of the loudspeaker with respect to the diaphragm, one end portion of each diaphragm/elastic member connecting member being connected to the diaphragm; and an elastic member connected to the other end portion of each diaphragm/elastic member connecting member which support the diaphragm so as to allow the diaphragm to vibrate freely by connecting the elastic member to the frame.

In still another embodiment, the loudspeaker further includes: a plate-shaped voice coil bobbin/elastic member connecting member provided on an opposite side to the sound radiating side of the loudspeaker with respect to the diaphragm, one end portion of each voice coil bobbin/elastic member connecting member being connected to the voice coil bobbin; and an elastic member having a pair of semi-cylindrical portions connected to each other by interposing the other end of the voice coil bobbin/elastic member connecting member which supports the diaphragm so as to allow the diaphragm to vibrate freely by connecting the elastic member to the frame.

In still another embodiment, the edge portion projects in an opposite direction to a projecting direction of the elastic member.

In still another embodiment, the elastic member includes a concave portion provided between the pair of semi-cylindrical portions and the voice coil bobbin/elastic member connecting member is connected to the elastic member at the concave portion.

In still another embodiment, the voice coil bobbin/elastic member connecting member is further connected to an internal face of the diaphragm.

In still another embodiment, the diaphragm projects towards the sound radiating direction and includes a reinforcing member connected to an internal face of the diaphragm.

In still another embodiment, the diaphragm, the voice coil bobbin, the voice coil bobbin/elastic member connecting member and the reinforcing member are integrally formed using a resin material.

In still another embodiment, a number of the reinforcing members is at least three, and the reinforcing members are disposed so as to be separated at unequal intervals.

In still another embodiment, a ratio of a larger diameter of the diaphragm to a smaller diameter thereof is equal to or larger than 6.

In still another embodiment, a ratio of a width of the curvilinear portions of the edge portion in the larger diameter direction to a width of the linear portions of the edge portion in the smaller diameter direction is in a range of 2 to 3.

Thus, the invention described herein makes possible the advantage of providing a loudspeaker of an elongate shape having the following features allowing for eliminating previously mentioned various problems of a cone-shaped slim loudspeaker and a dome-shaped loudspeaker.

That is to say, according to a loudspeaker of the invention, sound may be reproduced in a wide frequency bandwidth, so that sound with improved frequency characteristics may be reproduced from a low sound region to a high sound region.

In addition, in a loudspeaker of the invention, a higher harmonic resonance is not likely to occur in the diaphragm, so that flat frequency characteristics may be obtained.

Moreover, even if a rolling is generated about the larger diameter direction of the diaphragm, the voice coil is not in contact with a magnetic circuit. Accordingly, it is possible to apply a relatively large input to the loudspeaker even in a low sound region.

Furthermore, according to the invention, the resonance amplitude of the voice coil bobbin is small, so that the voice coil does not come into contact with the magnetic circuit easily.

A loudspeaker of this invention includes a diaphragm, a voice coil bobbin, voice coil bobbin reinforcing members, and a plurality of magnetic circuits.

The planar shape of the diaphragm when it is viewed from the vibration direction of the diaphragm is non-axisymmetric having a larger diameter and a smaller diameter. In addition, the planar shape of the voice coil bobbin when it is viewed from the vibration direction of the diaphragm is also non-axisymmetric having a larger diameter and a smaller diameter, and the parts of the voice coil bobbin form linear portions so as to be opposed in parallel to each other with respect to the larger diameter direction of the diaphragm. The voice coil bobbin reinforcing members are thin-plate members bridged between the parallel planes opposed to each other with respect to the smaller diameter direction of the diaphragm in a direction parallel to the vibration direction of the diaphragm and vertical to the opposed planes. The magnetic circuits supply magnetic fluxes to the parallel linear portions of the voice coil wound around the voice coil bobbin. The magnetic circuits are provided being separated from each other by a predetermined distance so as to allow the voice coil bobbin reinforcing members to vibrate freely.

By using the above-mentioned structure, according to the present invention, the following effects may be obtained.

In a loudspeaker of this invention, substantially the entire portion of the diaphragm is subjected to the driving force of the voice coil bobbin unlike a cone-shaped slim loudspeaker. Accordingly, a higher harmonic resonance is not likely to occur in the diaphragm, so that flat frequency characteristics may be obtained, and in addition, sound with improved frequency characteristics may be reproduced up to a high frequency band.

The voice coil bobbin is included within an air gap of the magnetic circuits only in the linear portions parallel to each other with respect to the larger diameter direction of the diaphragm. Therefore, even if a rolling is generated about the larger diameter direction of the diaphragm, this structure prevents the voice coil from coming into contact with the magnetic circuits. As a result, it is possible to apply a relatively large input to the loudspeaker even in a low sound region.

The voice coil bobbin reinforcing members are bridged between the opposed planes of the voice coil bobbin. Therefore, the resonance amplitude of the voice coil bobbin is reduced, so that the voice coil does not come into contact with the magnetic circuits easily.

Preferably, a loudspeaker of the invention further includes dampers and voice coil bobbin/damper connecting members.

The dampers are linearly shaped members and include elastic members disposed below the voice coil bobbin so as be parallel to each other in a smaller diameter direction of the diaphragm. The voice coil bobbin/damper connecting members are thin-plate members disposed so as to be parallel to each other in the smaller diameter direction and vibration direction of the diaphragm. The upper end portion of each of the connecting members is attached to the voice coil bobbin, and the lower end portion thereof is attached to each of the dampers so that the members vibrate freely while being retained. The magnetic circuits are provided being separated by a predetermined distance so as to sandwich the voice coil bobbin reinforcing members and the voice coil bobbin/damper Connecting members so as to allow the members to vibrate freely.

As a result, the following effects may be further obtained.

The supporting characteristics of the diaphragm for preventing a rolling about the smaller diameter direction may be remarkably improved, so that substantially no rolling is generated about this direction. Accordingly, the maximum input power of the loudspeaker may be further improved.

The dampers are linearly shaped, so that the rigidity thereof may be reduced as compared with the dampers of a cone-shaped slim loudspeaker. Accordingly, the lowest resonance frequency $f_0$ of the loudspeaker may be reduced, so that frequency characteristics may be improved in a low sound region.

These and other advantages of the present invention will become apparent to those skilled in the art upon reading and understanding the following detailed description with reference to the accompanying figures.

BRIEF DESCRIPTION OF THE DRAWINGS

FIG. 1*a*, is a plan view; FIG. 1B is a cross-sectional view .taken along the larger diameter direction; and FIG. 1C is a cross-sectional view taken along the smaller diameter direction of the loudspeaker.

FIG. 3A is a graph showing the frequency characteristics of the loudspeaker according to the first example of the invention, while In FIGS. 3A and 3B, the ordinates indicate a sound pressure level and the abscissas indicate a frequency.

FIG. 4A is a plan view; FIG. 4B is a cross-sectional view taken along the larger diameter direction; and FIG. 4C is a cross-sectional view taken along the smaller diameter direction of the loudspeaker.

FIG. 5A is a cross-sectional view taken along the larger diameter direction; FIG. 5B is a cross-sectional view taken along the smaller diameter direction; and FIG. 5C is a perspective view showing only one magnetic circuit for the loudspeaker.

FIG. 7A is a cross-sectional view taken along the larger diameter direction; FIG. 7B is a cross-sectional view taken along the smaller diameter direction; and FIG. 7C is a perspective view showing only one magnetic circuit of the loudspeaker.

FIG. 8A is a cross-sectional view taken along the larger diameter direction and FIG. 8B is a cross-sectional view taken along the smaller diameter direction of the loudspeaker.

In FIG. 9, the ordinates indicate a sound pressure level and the abscissas indicate a frequency.

In FIG. 11A, the ordinates indicate a sound pressure level, and the abscissas indicate a frequency.

In FIG. 11B, the ordinates indicate a sound pressure level, and the abscissas indicate a frequency.

FIG. 13A is a plan view; FIG. 13B is a cross-sectional view taken along the larger diameter direction; and FIG. 13C is a cross-sectional view taken along the smaller diameter direction of the loudspeaker.

FIG. 14A is a plan view; FIG. 14B is a cross-sectional view taken along the larger diameter direction; and FIG. 14C is a cross-sectional view taken along the smaller diameter direction of the loudspeaker.

FIG. 17A is a perspective view and FIG. 17B is a cross-sectional view taken along the smaller diameter direction of the damper.

DESCRIPTION OF THE PREFERRED EMBODIMENTS

Figures 1A, 1B, 1C:
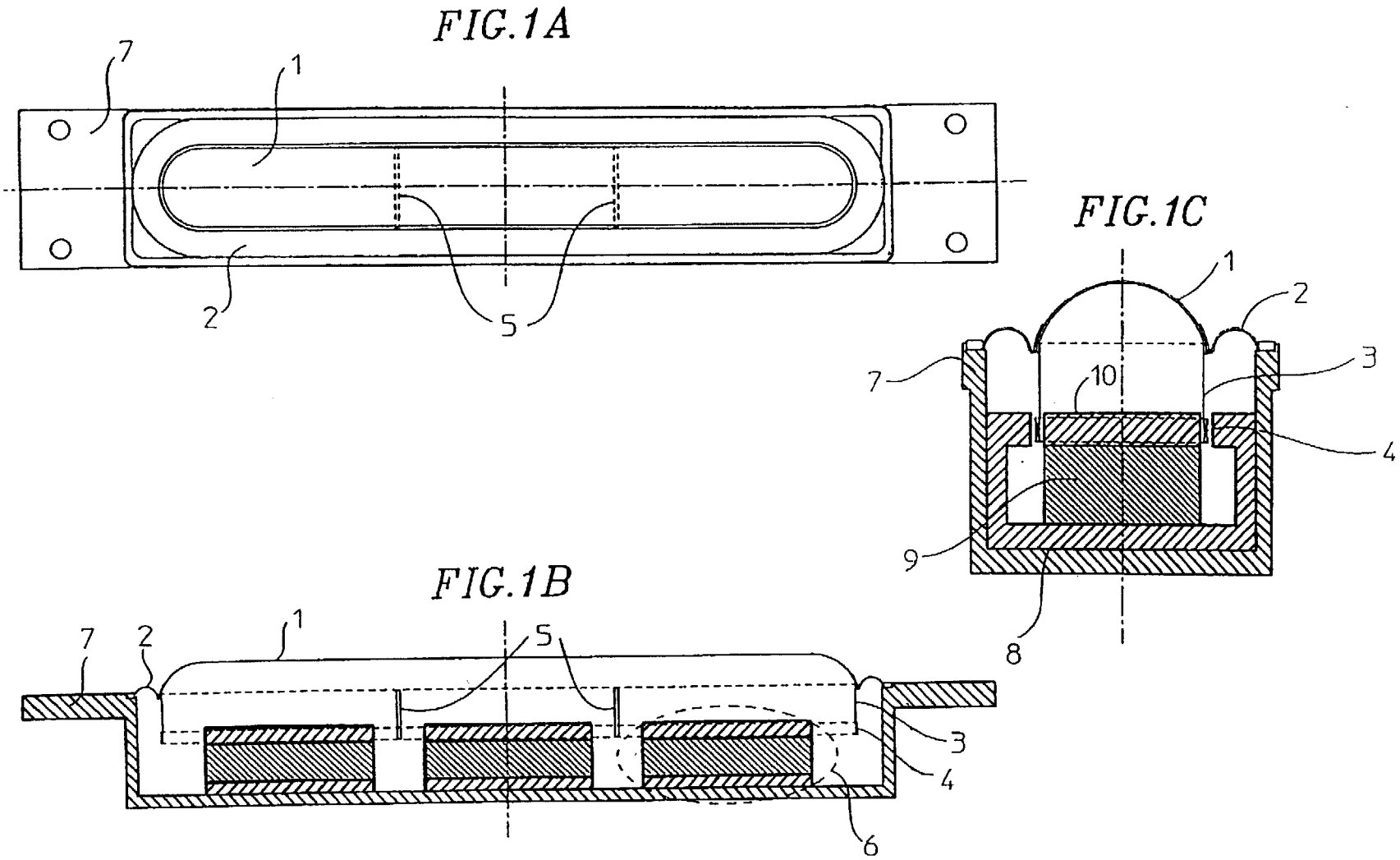
FIGS. 1A to 1C show a configuration for a loudspeaker according to a first example of the present invention.

Hereinafter, the present invention will be described by way of illustrative examples with reference to the accompanying drawings. It is noted that the same reference numerals denote the same components throughout the following examples.

EXAMPLE 1

Figure 2:
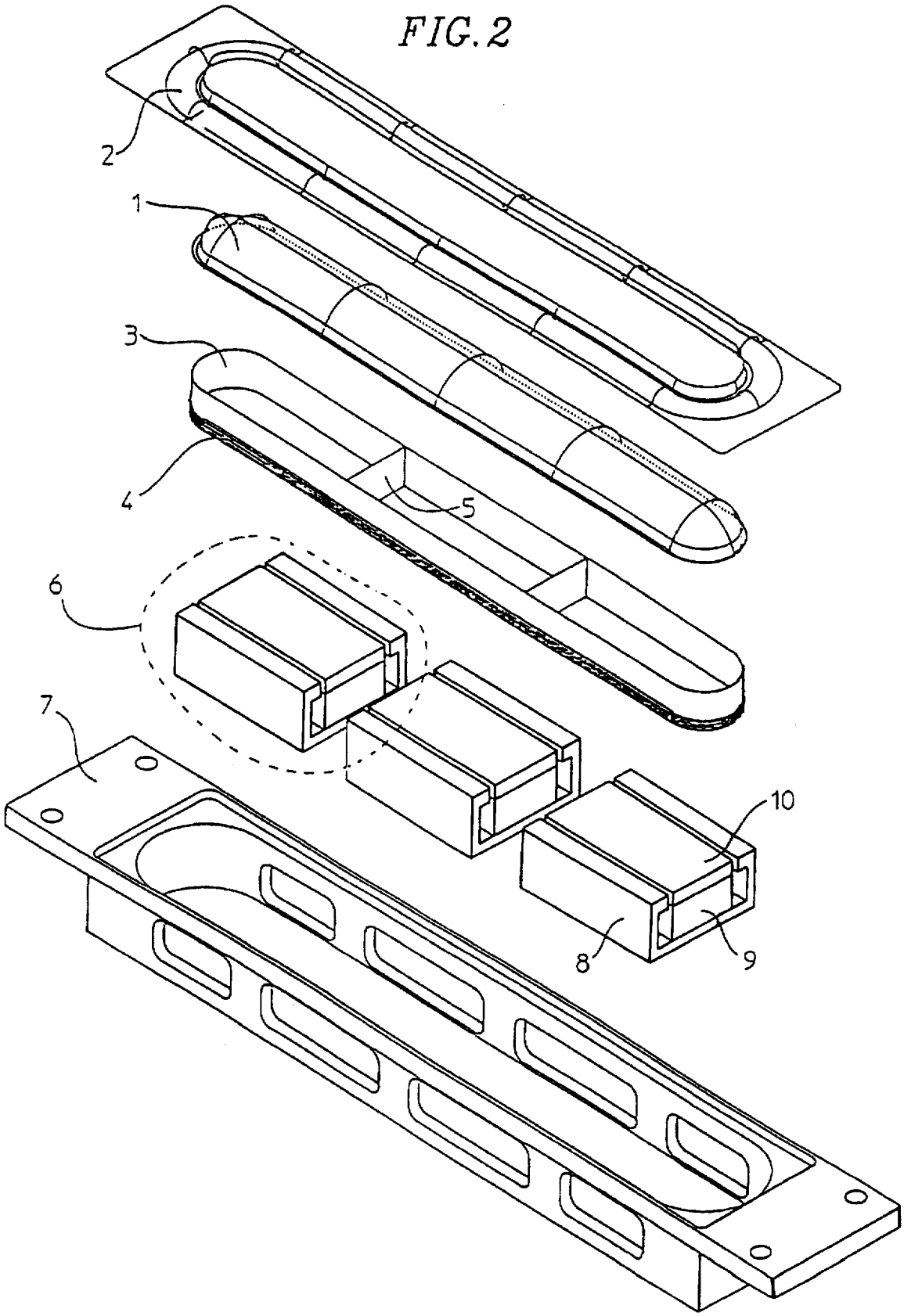
FIG. 2 is an exploded perspective view of the respective components to be assembled for the loudspeaker according to the first example of the present invention.

A loudspeaker according to a first example of the present invention will be described referring to FIGS. 1 to 4. FIGS. 1A to 1C show the configuration for a loudspeaker of Example 1. FIG. 1A is a plan view; FIG. 1B is a cross-sectional view taken along the larger diameter direction; and FIG. 1C is a cross-sectional view taken along the smaller diameter direction of the loudspeaker. FIG. 2 is an exploded perspective view of the respective components of the loudspeaker of Example 1. In FIGS. 1A to 1C and FIG. 2, an edge 2 is joined to a dome-shaped diaphragm 1, substantially in an oval shape, in the outer peripheral portion thereof, and is retained by a frame 7.

The planar shape of a voice coil bobbin 3 when it is viewed from the vibration direction thereof, i.e., from above FIG. 1B, is substantially oval. Some parts of the voice coil bobbin 3 form linear portions parallel to each other in the larger diameter direction. The upper end portion of the voice coil bobbin 3 is attached to the diaphragm 1, end a voice coil 4 is wound around the lower end portion thereof.

Voice coil bobbin reinforcing members 5, fixed inside the voice coil bobbin 3, are bridged between the planes opposed to each other with respect to the smaller diameter direction. The voice coil bobbin reinforcing members 5 are plate-shaped members made of paper or the like. In this example, two members are attached at the two positions obtained by dividing the larger diameter of the voice coil bobbin 3 into three portions having substantially the same length. The voice coil bobbin reinforcing members 5 shown in FIG. 1A are vertically bridged between the opposed planes parallel to each other of the voice coil bobbin 3, thereby preventing the generation of the higher harmonic resonance in the voice coil bobbin 3.

Three magnetic circuits 6 are attached on the upper bottom face of the frame 7. Each magnetic circuit 6 is an inner magnet type magnetic circuit including a yoke 8, a magnet 9 and a plate 10. The magnet 9 attached to the upper bottom face of the yoke 8 is magnetized in a vibration direction of the diaphragm 1. The magnetic circuits 6 are provided being separated from each other by a predetermined gap so as to interpose the voice coil bobbin reinforcing members 5. Accordingly, the voice coil bobbin reinforcing members 5 are not in contact with the magnetic circuits 6. The magnetic circuits 6 apply magnetic fluxes to the linear portions parallel to each other of the voice coil 4.

Figure 3A:
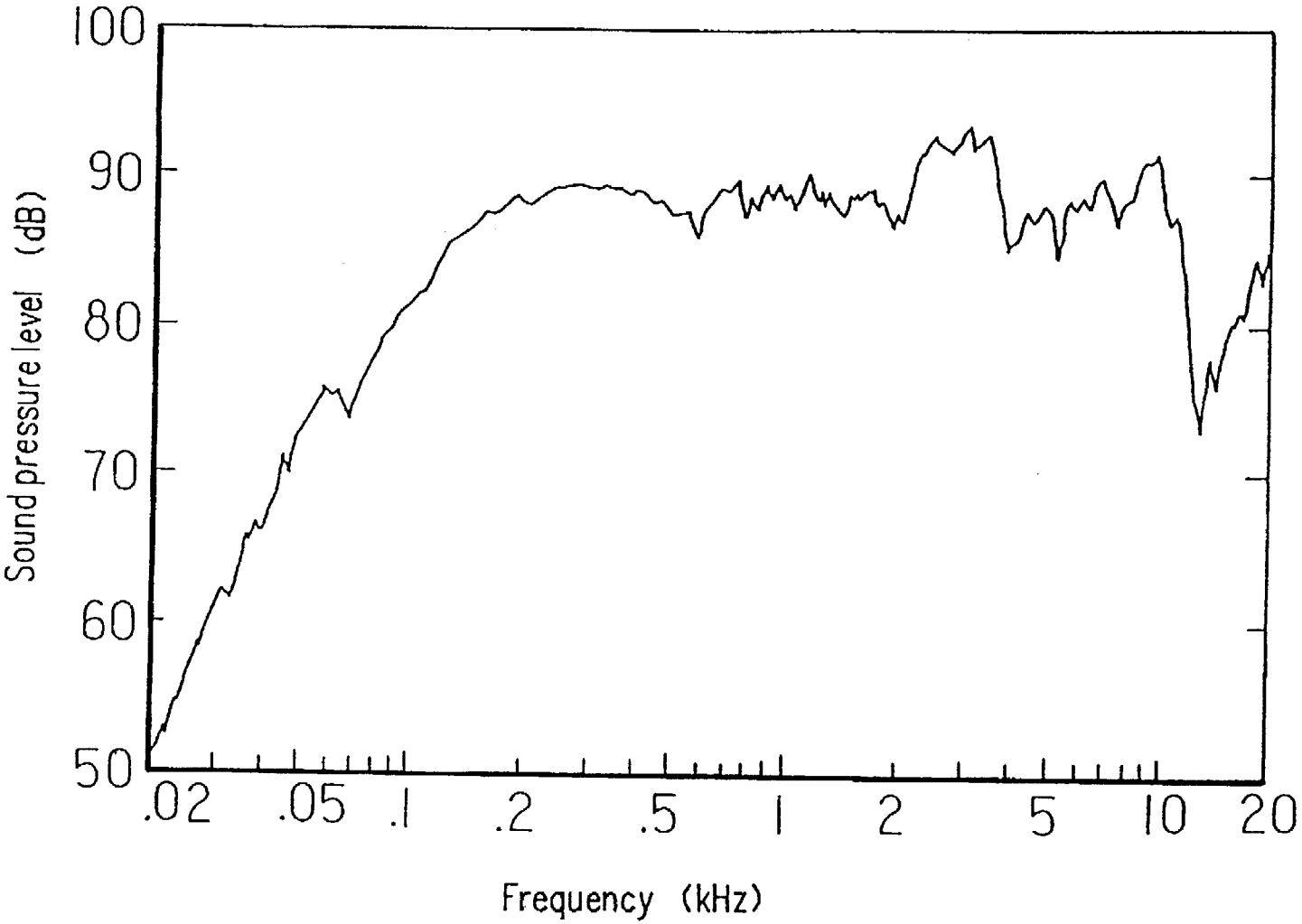
Figure 3B:
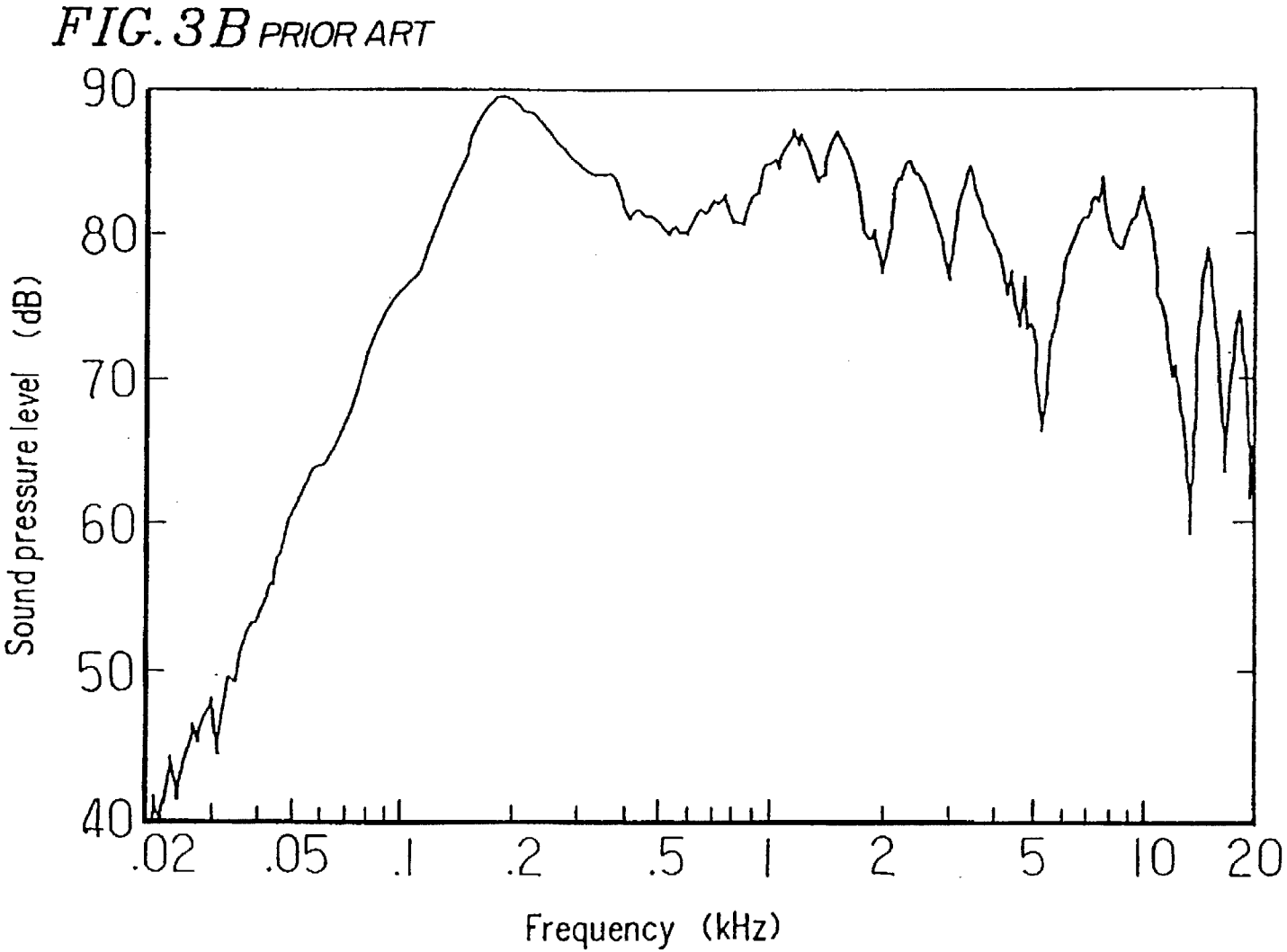
FIG. 3B PRIOR ART
FIG. 3B is a graph showing the frequency characteristics of a conventional cone-shaped slim loudspeaker.

In a loudspeaker having the above-described configuration, since substantially the entire portion of the diaphragm 1 is subjected to a driving force, a higher harmonic resonance is not likely to occur in the diaphragm 1. As a result, flat frequency characteristics may be obtained and sound with improved frequency characteristics may be reproduced up to a high sound region. FIG. 3A is a graph showing the frequency characteristics of the loudspeaker according to the first example of the invention, while FIG. 3B is a graph showing the frequency characteristics of a conventional cone-shaped slim loudspeaker. In FIGS. 3A and 3B, the ordinates indicate a sound pressure level and the abscissas indicate a frequency. The signal input to the loudspeaker has a sine wave having a power of 1 W. The measurement is performed at a point 1 m away from the center of the loudspeaker in a perpendicular direction thereto. As is apparent from the comparison of the results shown in FIGS. 3A and 3B, there are fewer peaks and dips in the frequency characteristics of the loudspeaker of this example as compared with the conventional cone-shaped slim loudspeaker. Consequently, in the loudspeaker of this example, flat frequency characteristics are exhibited, and sound with improved frequency characteristics may be reproduced up to a higher sound region.

In addition, a relatively large input may be applied to the loudspeaker of this example even in a low sound region. This is because the structure of the loudspeaker prevents the voice coil from coming into contact with the magnetic circuits, even if a rolling is generated about the larger diameter direction of the diaphragm.

In a conventional oval voice coil bobbin, a resonance is generated in the linear portions of the voice coil bobbin at certain frequencies, so that the voice coil bobbin vibrates in a direction vertical to the vibration direction of the diaphragm. If the input to be applied to the loudspeaker increases, then the voice coil bobbin is possibly in contact with the magnetic circuits because of the generated resonance. However, in the loudspeaker of this example, this possibility is small. This is because the existence of the voice coil bobbin reinforcing members 5 bridged between the opposed planes of the voice coil bobbin 3 reduces the amplitude of the vibrating voice coil bobbin when the resonance is generated. Consequently, in this example, the ratio of the larger diameter to the smaller diameter (a larger/smaller diameter ratio) of the diaphragm 1 may be set to be equal to 6 or more without degrading the frequency characteristics. In the following examples of the invention, it is also possible to set the larger/smaller diameter ratio of the diaphragm 1 to be 6 or more.

Hereinafter, the vibration characteristics obtained by the comparison between a loudspeaker of this example and a loudspeaker deprived of the voice coil bobbin reinforcing members 5 will be analyzed. First, the natural frequency of the entire vibration system is analyzed by a finite element method. Next, the amplitude of the voice coil bobbin in the smaller diameter direction is calculated by driving the voice coil at a natural frequency also by a finite element method. The level of the driving force is 1 [N]. The data of the respective material constants are shown in Table 1, while the calculation results are shown in Table 2. In Tables 1 and 2, "2.10E9" indicates "$2.10\times10^{9}$", for example. As is apparent from Table 2, in the loudspeaker of this example, the maximal value of the resonance amplitude is reduced to a tenth by providing the bridged voice coil bobbin reinforcing members 5 as compared with a conventional voice coil bobbin. In Table 2, $f_1'$ to $f_4'$ and $f_1$ to $f_4$ denote natural frequencies in the two cases where the reinforcing members are provided and not provided, respectively.

TABLE 1

Material Constants of Components for Loudspeaker

| component | elastic modulus ($N/m^2$) | Poisson's ratio | density ($kg/m^3$) | internal loss (tanδ) | thickness (m) |
|---|---|---|---|---|---|
| A | 2.10E9 | 0.3 | 5.51E2 | 2.50E-2 | 2.57E-4 |
| B | 1.22E8 | 0.4 | 7.97E2 | 1.21E-1 | 1.73E-4 |
| C | 1.82E10 | 0.345 | 1.90E3 | 1.85E-2 | 1.61E-4 |
| D | 1.40E10 | 0.345 | 1.52E3 | 1.23E-2 | 4.83E-4 |
| E | 2.13E9 | 0.3 | 7.55E2 | 3.70E-2 | 1.26E-3 |

In Table 1, the respective components A to E and the respective materials thereof (in the parentheses) for the loudspeaker are as follows.

A: diaphragm (paper pulp)

B: edge (cloth)

C: voice coil bobbin (aluminum reinforced with kraft paper)

D: voice coil wound bobbin (copper line and aluminum)

E: voice coil bobbin reinforcing member (cardboard)

TABLE 2

Natural Frequency of Loudspeaker and Amplitude of Voice Coil Bobbin

| | | $f_1'$ | $f_2'$ | $f_3'$ | $f_4'$ |
|---|---|---|---|---|---|
| reinforcing members provided | natural frequency [Hz} | 96.1 | 493.1 | 582.0 | 1033.9 |
| | amplitude [m] | 0.139E-3 | 0.216E-3 | 0.138E-3 | 0.723E-4 |
| | | $f_1$ | $f_2$ | $f_3$ | $f_4$ |
| reinforcing members deprived | natural frequency [Hz] | 102.5 | 175.2 | 450.0 | 760.0 |
| | amplitude [m] | 0.177E-2 | 0.216E-2 | 0.144E-3 | 0.913E-4 |

In this example, a cylindrical voice coil bobbin 3 is used. However, the shape of the voice coil bobbin 3 is not limited thereto, but may be a mesh-type or a skeleton-type in order to reduce the weight thereof.

The material and the number of the voice coil bobbin reinforcing members 5 and the number of the magnetic circuits 6 are not particularly limited to those described in this example. As long as the voice coil bobbin reinforcing members 5 may vibrate freely without coming into contact with the magnetic circuits 6, the voice coil bobbin reinforcing members 5 are not necessarily required to be vertically bridged between the opposed parallel planes of the voice coil bobbin 3.

Figure 4A:
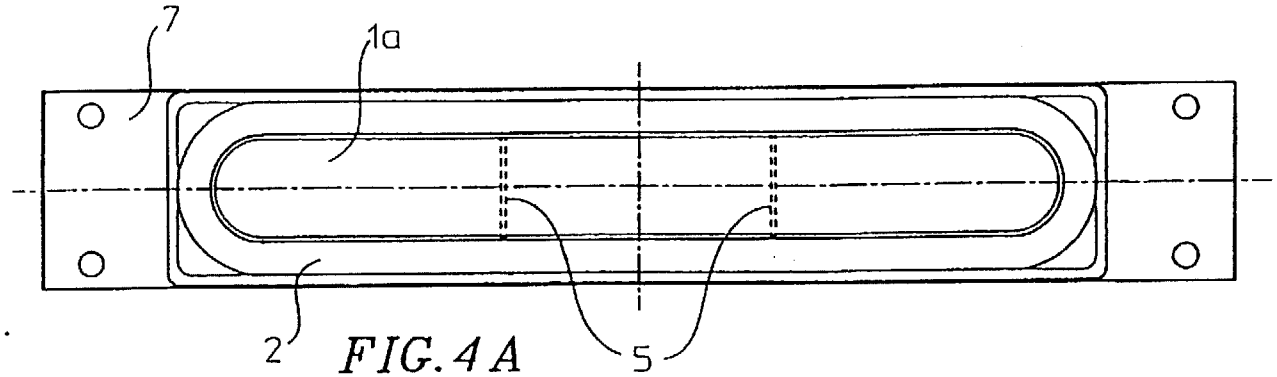
FIGS. 4A to 4C show another configuration for a loudspeaker according to the first example of the present invention.
Figure 4B:
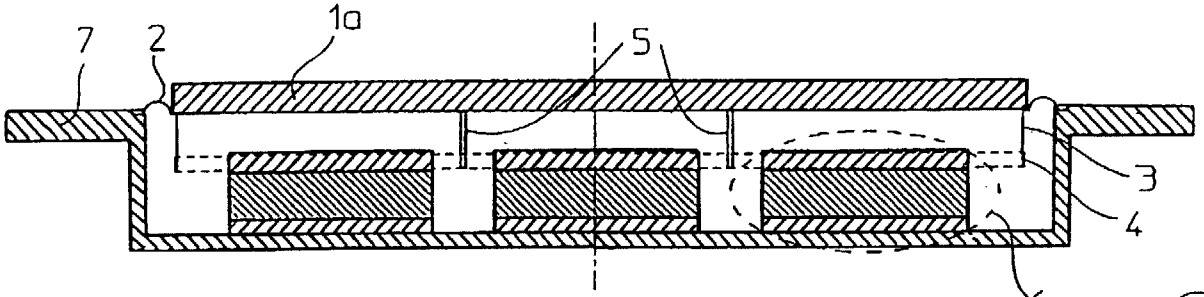
Figure 4C:
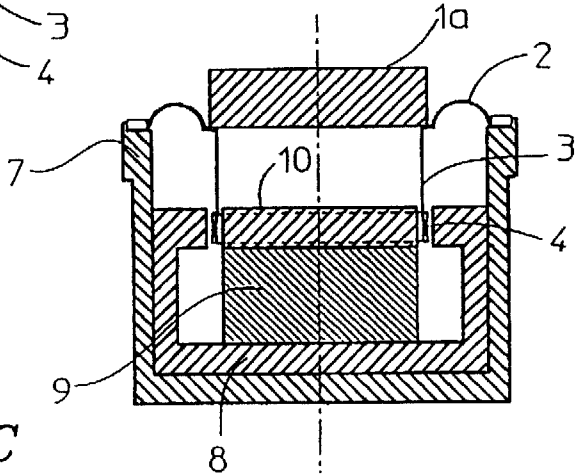

It is noted that the material and the number of voice coil bobbin reinforcing members 5 to be provided, and the number of magnetic circuits 6 to be provided are not limited to those described above in this example. With respect to the diaphragm 1, the same effects may be attained by employing a plane diaphragm 1*a* instead of the dome-shaped diaphragm 1, as shown in FIGS. 4A to 4C. A light-weight material having a honeycomb structure or the like may be used as the plane diaphragm 1*a*.

It is not necessarily required for the plane diaphragm 1 to include linear parallel portions. The shape of the plane diaphragm 1 may be, for example, polygonal or elliptical, in place of the oval shape including linear parallel portions. Moreover, both the end portions of the oval shape are not necessarily required to be a part of a real circle. Alternatively, the end portions may be parts of a polygon or an ellipse.

EXAMPLE 2

Figure 5A:
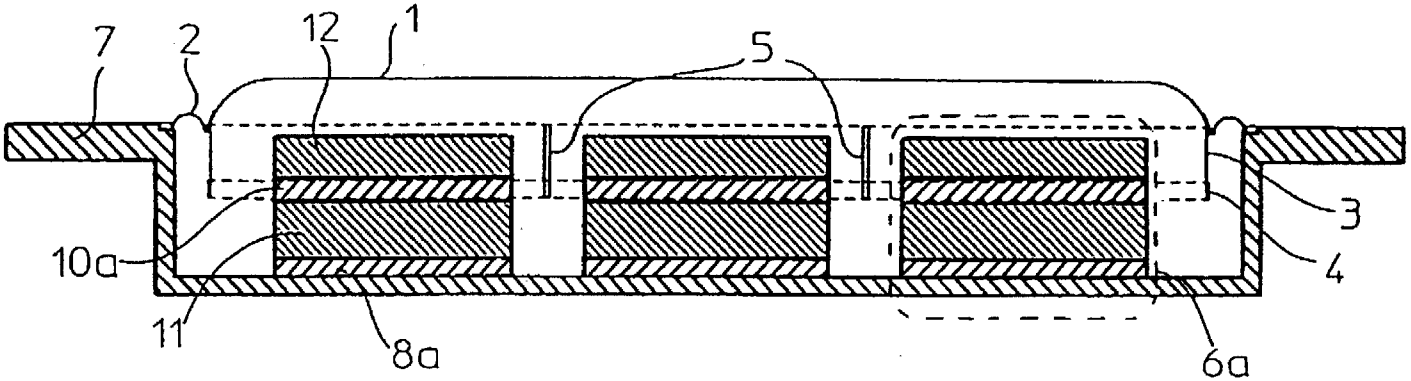
FIGS. 5A to 5C show a configuration for a loudspeaker according to a second example of the present invention.
Figure 5C:
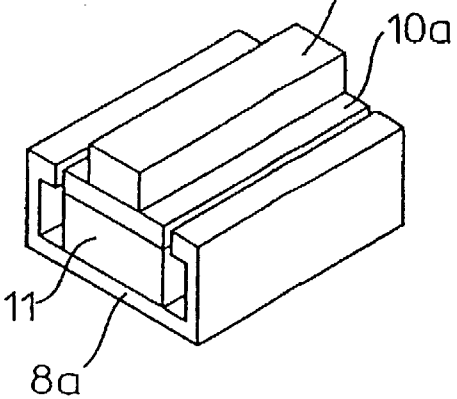
Figure 5B:
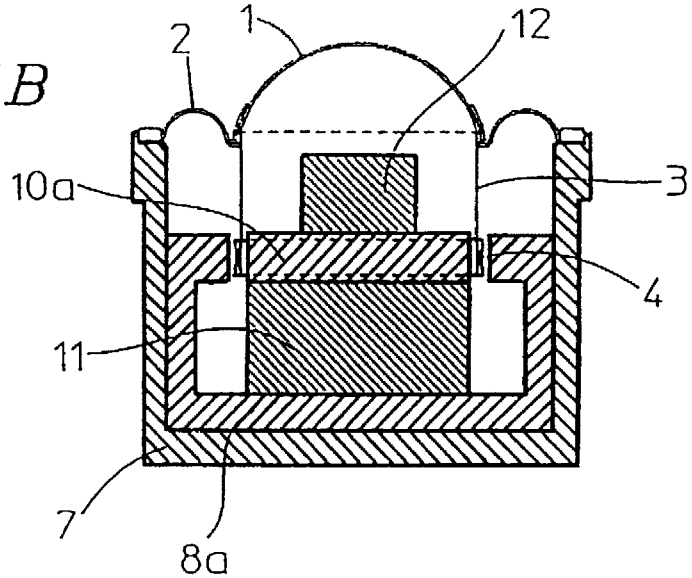

Hereinafter, a loudspeaker according to a second example of the invention will be described with reference to FIGS. 5A to 5C and FIGS. 6A and 6B. FIGS. 5A to 5C show a configuration for a loudspeaker according to the second example of the present invention. FIG. 5A is a cross-sectional view taken along the larger diameter direction; FIG. 5B is a cross-sectional view taken along the smaller diameter direction; and FIG. 5C is a perspective view showing only one magnetic circuit for the loudspeaker. The same components as those used in the first example are denoted by the same reference numerals and the description thereof will be omitted herein.

Each magnetic circuit 6*a* includes a yoke 8*a*, a first magnet 11, a plate 10*a* and a second magnet 12. As shown in FIG. 5B, the yoke 8*a* is a magnetic body formed in a groove shape, and the cross section thereof in the smaller diameter direction is U shaped. The first magnet 11 is a square-pillar shaped ferrite magnet magnetized in the vibration direction of the diaphragm 1 and mounted on the upper bottom face of the yoke 8*a*. The plate 10*a* is a magnetic body formed in a square-pillar shape, and fixed on the upper surface of the first magnet 11, thereby conducting magnetic fluxes to the air gaps opposed to the inner peripheral side portions of the yoke 8*a*. The second magnet 12 fixed on the upper surface of the plate 10*a* is a square-pillar shaped ferrite magnet magnetized so as to have an opposite polarity to that of the first magnet 11.

Figure 6A:
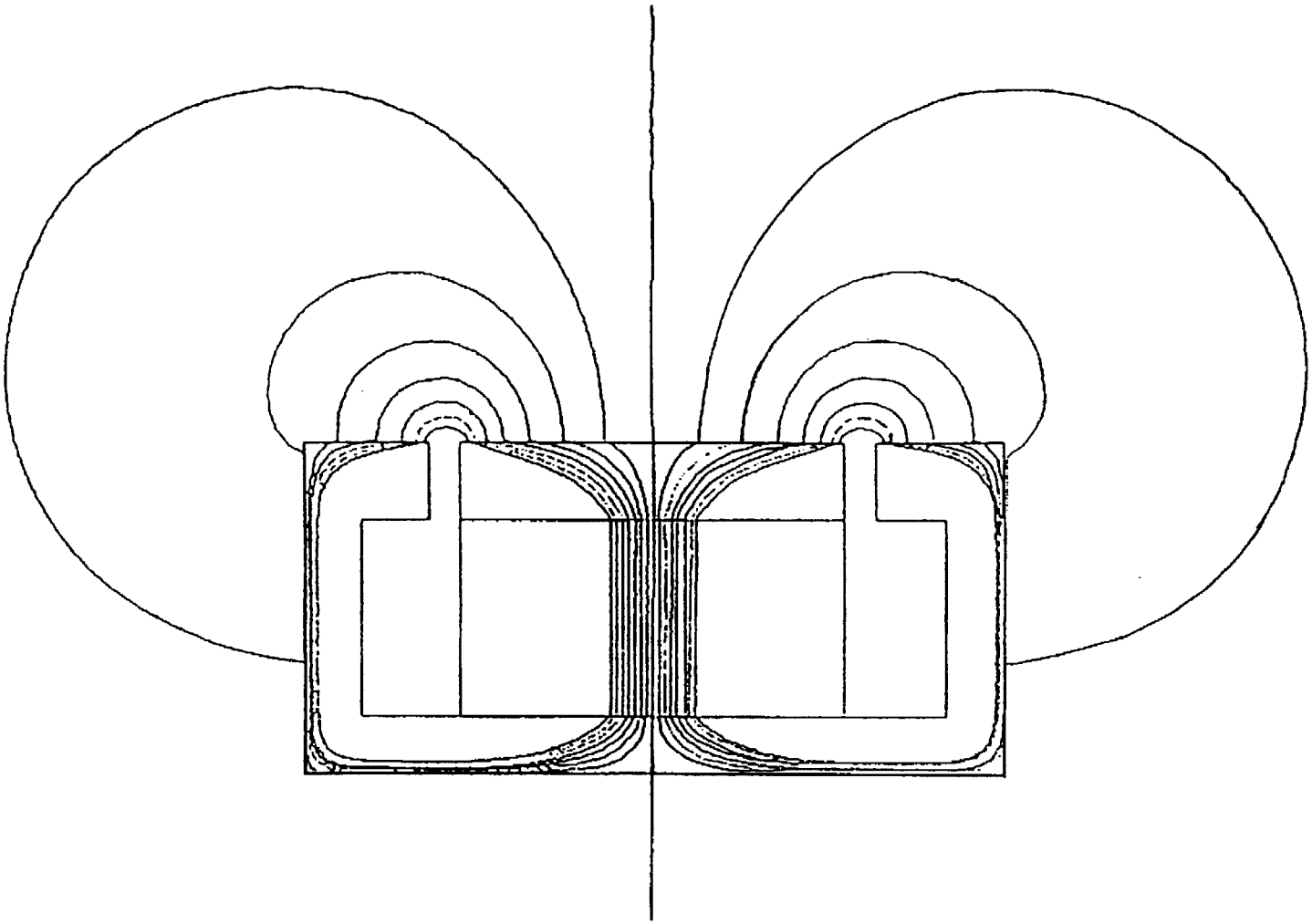
FIG. 6A is a cross-sectional view taken along the smaller diameter direction showing the flow of the magnetic fluxes inside and around a magnetic circuit according to the first example of the invention.
Figure 6B:
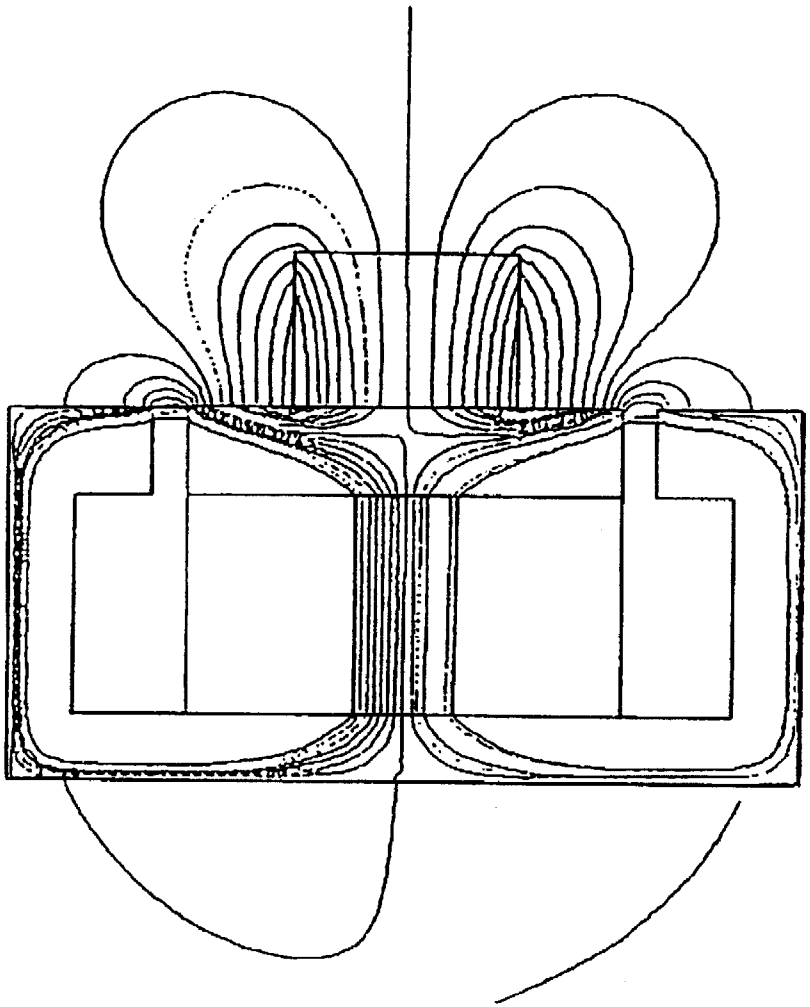
FIG. 6B is a cross-sectional view taken along the smaller diameter direction showing the flow of the magnetic fluxes inside and around a magnetic circuit according to the second example of the invention.

In the magnetic circuits of this example, the magnetic fluxes may be utilized more efficiently and enable more effective sound reproduction from the loudspeaker as compared with the magnetic circuits of the first example. FIGS. 6A and 6B are cross-sectional views taken along the smaller diameter direction of the magnetic circuits of the first and the second examples showing the flow of the magnetic fluxes inside and around the respective magnetic circuits. In these figures, the flow of the magnetic fluxes inside and around the respective magnetic circuits which is obtained by calculation is drawn. In the magnetic circuit of the first example, some of the magnetic fluxes generated from the magnet leak from the upper surface of the plate. Accordingly, the magnetic fluxes can not be utilized so efficiently, and therefore the density of the magnetic fluxes inside the air gap is 4550 gauss.

On the other hand, in the magnetic circuit of this example, the magnetic fluxes leaking from the upper surface of the plate are enclosed inside the air gap by the second magnet. As a result, the utility efficiency of the magnetic fluxes is higher than that of the magnetic circuit of the first example, and the density of the magnetic fluxes inside the air gap increases to 5190 gauss. Consequently, the sound may be reproduced more effectively from the loudspeaker. In addition, since the magnetic fluxes are concentrated inside a narrow space by the first and the second magnets, the magnetic circuit of this example is excellent in preventing the leakage of magnetic fluxes.

In this example, a ferrite magnet is used as a magnet for the loudspeaker. However, the same effects as those of this example may be attained in the case where other kinds of magnets, e.g., an alnico magnet, are used.

EXAMPLE 3

Figure 7A:
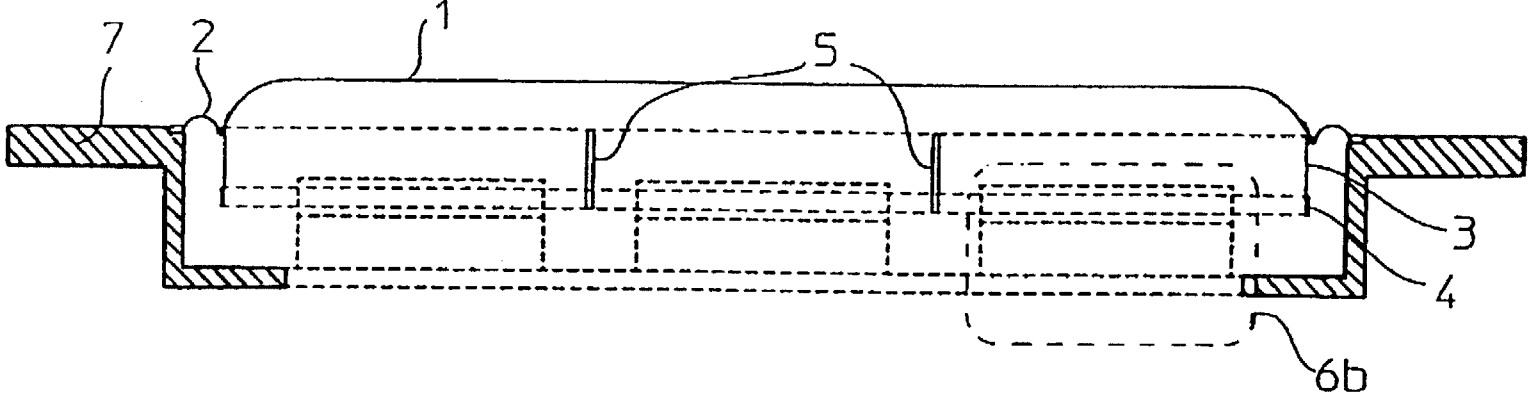
FIGS. 7A to 7C show a configuration for a loudspeaker according to a third example of the present invention.
Figure 7B:
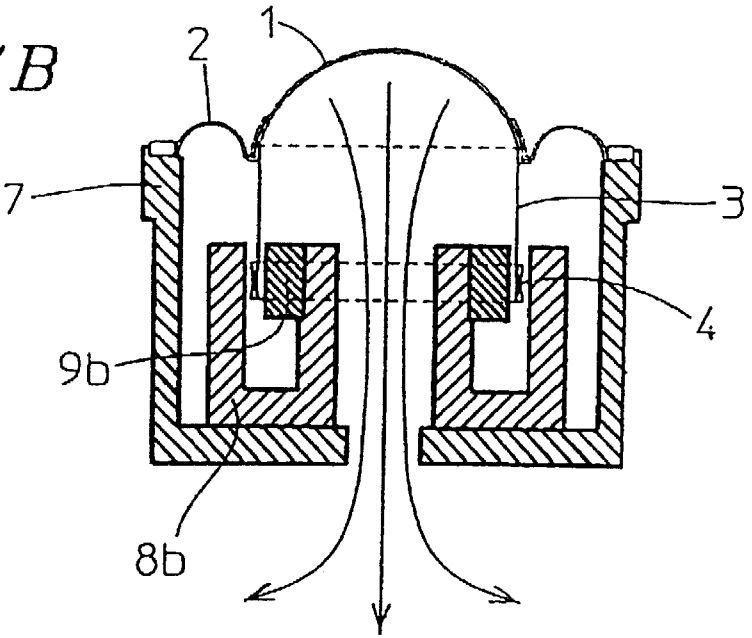
Figure 7C:
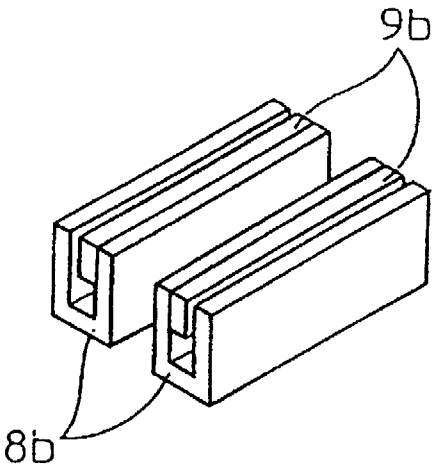

Next, a loudspeaker according to a third example of the invention will be described with reference to FIGS. 7A to 7C. FIGS. 7A to 7C show a configuration for a loudspeaker according to the third example of the present invention. FIG. 7A is a cross-sectional view taken along the larger diameter direction; FIG. 7B is a cross-sectional view taken along the smaller diameter direction; and FIG. 7C is a perspective view showing only one magnetic circuit including a pair of yokes 8*b* for the loudspeaker. In this example, all the components to be used are the same as those of the first example except for the magnetic circuits 6*b*. So the description thereof will be omitted herein.

As shown in FIG. 7C, each magnetic circuit 6*b* includes two yokes 8*b* symmetrically disposed as to form a pair with respect to the smaller diameter direction. In addition to the pair of yokes 8*b* having U shaped cross sections, the magnetic circuit 6*b* further includes two magnets 9*b* attached to the internal side faces of the yokes 8*b*. Each magnet 9*b* is attached to one of the internal side faces which is closer to the center line of the frame 7. The magnets 9*b* are Nd—Fe—B magnets magnetized towards the center in the smaller diameter direction of the diaphragm 1.

In the loudspeakers of the first and the second examples, the structure of the magnetic circuits 6 prevents the provision of holes for ventilation in the rear surface of the frame 7. As a result, the resonance mode possibly generates in the space inside the frame 7, so that the characteristics of the reproduced sound pressure level and the frequency are deteriorated in some cases.

On the other hand, in the magnetic circuit of this example, the frequency characteristics are not deteriorated. This is because the space provided in the center of each magnetic circuit allows ventilation in the rear surface of the frame.

In this example, a Nd—Fe—B magnet is used for the magnetic circuits. However, other kinds of magnets may also be used.

EXAMPLE 4

Figure 8A:
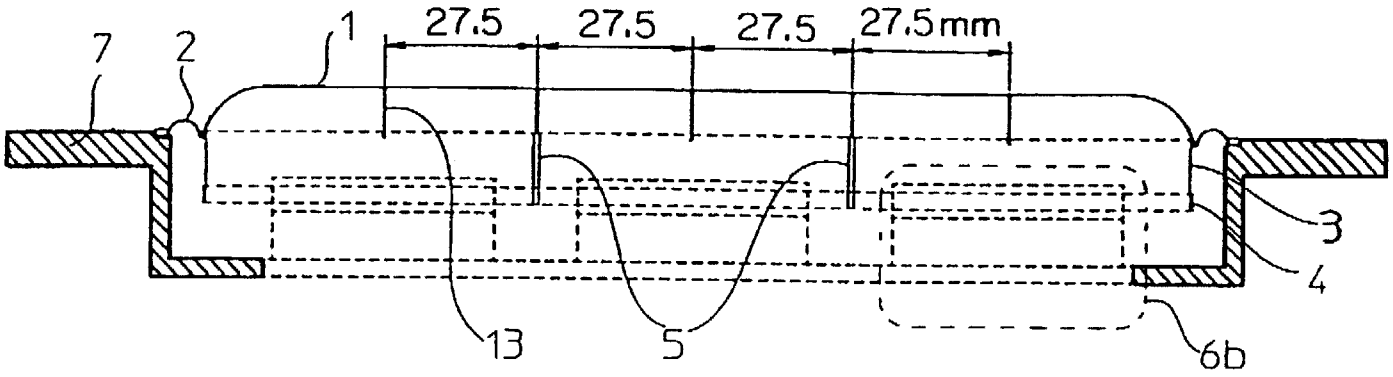
FIGS. 8A and 8B show a configuration for a loudspeaker according to a fourth example of the present invention.
Figure 8B:
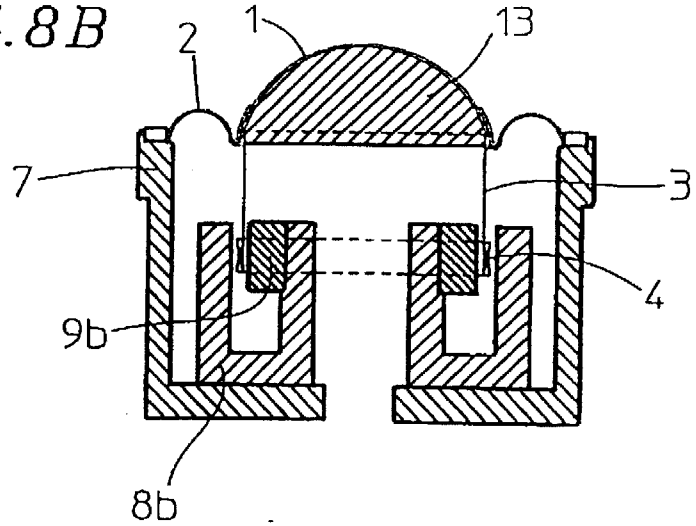

Next, a loudspeaker according to a fourth example of the invention will be described with reference to FIGS. 8A and 8B and FIG. 9. FIGS. 8A and 8B show a configuration for a loudspeaker according to the fourth example of the present invention. FIG. 8A is a cross-sectional view taken along the larger diameter direction; end FIG. 8B is a cross-sectional view taken along the smaller diameter direction of the loudspeaker. In this example, all the components to be used are the same as those of the third example except for the diaphragm 1. So the description thereof will be omitted herein.

The planar shape of the diaphragm 1 is non-axisymmetric having a larger diameter direction and a smaller diameter direction. The diaphragm 1 is projected upwards in the vibration direction thereof. A diaphragm reinforcing rib 13 is a D shaped thin plate made of paper. Five diaphragm reinforcing ribs 13 are disposed being separated from each other at equal intervals along the larger diameter direction of the diaphragm 1 so as to be attached to the reverse side of the diaphragm 1 in the smaller diameter direction.

If the diaphragm 1 lacks in the rigidity, then a resonance mode is generated in the smaller diameter direction at a low frequency, and the transverse vibration of the diaphragm 1 causes a high-level harmonic distortion in some cases. In the loudspeaker of this example, however, the level of this harmonic distortion is low. FIG. 9 shows the frequency characteristics accompanying second harmonic distortions in the loudspeaker of the third example (without using the diaphragm reinforcing ribs), where the weight of the diaphragm 1 is set to be 0.6 g, and the material thereof is paper pulp. The measurement of these characteristics is performed under the same conditions as those in FIGS. 3A and 3B. In this case, since the diaphragm lacks in the rigidity, a high-level distortion is generated in the vicinity of 630 Hz and 1740 Hz.

Figure 9:
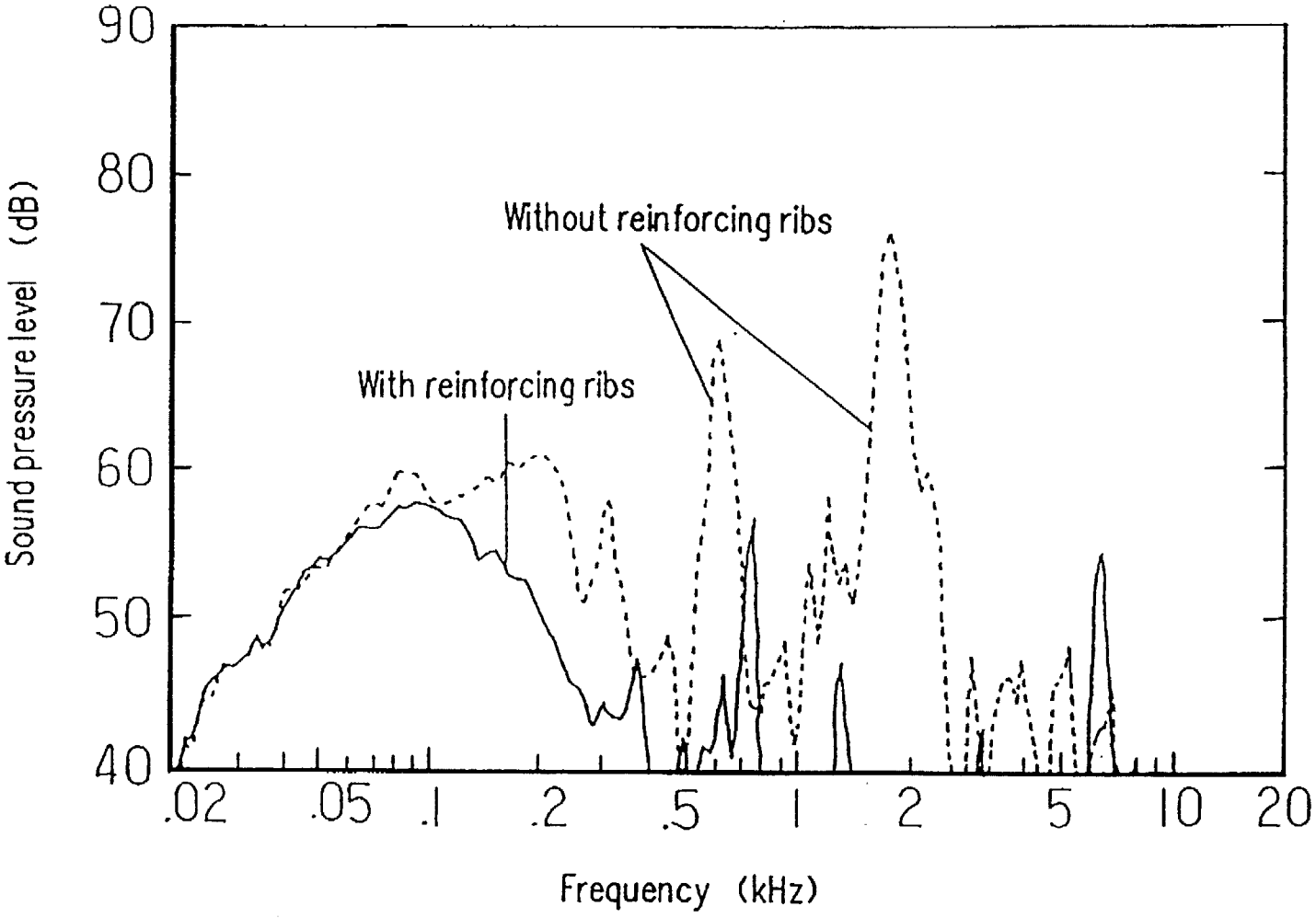
FIG. 9 is a graph showing frequency characteristics accompanying second harmonic distortion in the respective loudspeakers according to the first and the fourth examples of the invention.

The frequency characteristics accompanying second harmonic distortions in the diaphragm with the reinforcing ribs 13 are also shown in FIG. 9. The structure of the diaphragm of this example may suppress the generation of the resonance mode, so that the level of the distortion is reduced by 10 dB or more.

It is noted that the material and the number of the diaphragm reinforcing ribs are not limited to those employed in this example.

EXAMPLE 5

Figure 10:
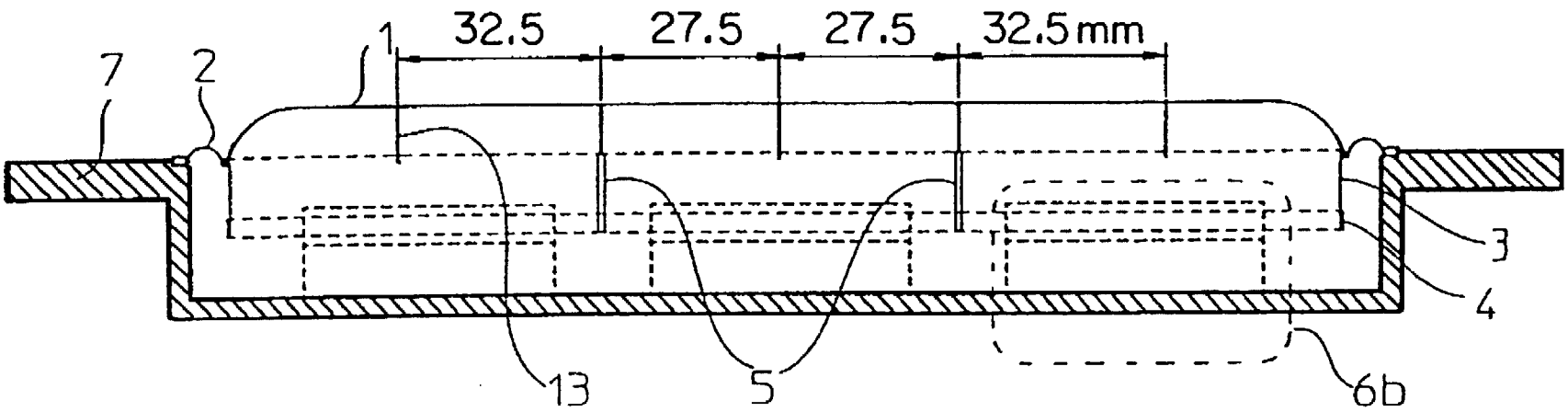
FIG. 10 is a cross-sectional view taken along the larger diameter direction of a loudspeaker according to a fifth example of the present invention.

Next, a loudspeaker according to a fifth example of the present invention will be described with reference to FIG. 10 and FIGS. 11A and 11B. FIG. 10 is a cross-sectional view taken along the larger diameter direction of a loudspeaker according to the fifth example of the present invention. In this example, the same components are used as those of Example 3, except for the diaphragm 1.

The same diaphragm 1 as that of Example 4 is used in this example. However, in this example, five diaphragm reinforcing ribs 13 are disposed being separated from each other at unequal intervals in the larger diameter direction of the diaphragm 1 so as to be attached to the reverse side of the diaphragm 1 in the smaller diameter direction as shown in FIG. 10.

Figure 11A:
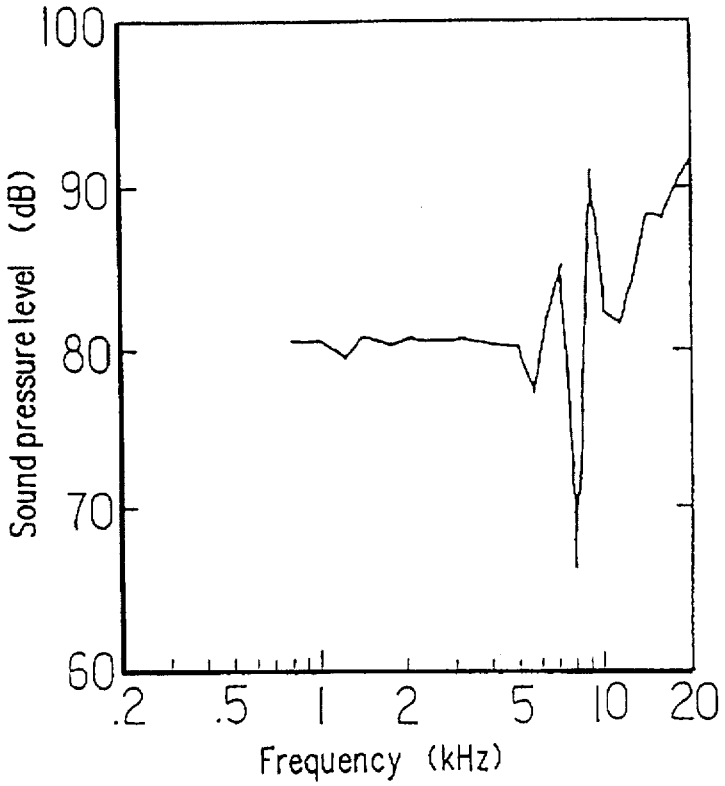
FIG. 11A is a graph showing a relationship between a reproduced sound pressure level and a frequency of a loudspeaker according to the fourth example of the invention.
Figure 11B:
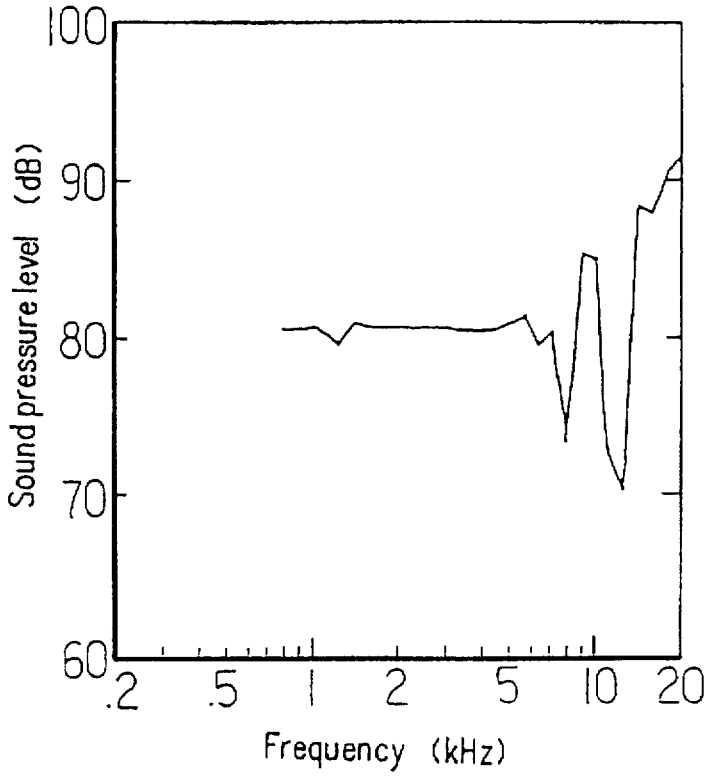
FIG. 11B is a graph showing a relationship between a reproduced sound pressure level and a frequency of a loudspeaker according to the fifth example of the invention.

FIGS. 11A and 11B show the relationship, simulated by calculation, between the reproduced sound pressure level and a frequency of the loudspeakers according to the fourth and fifth examples of the present invention, respectively. In these figures, the ordinates indicate the sound pressure level at a position 1 m away from the center of the loudspeaker in the perpendicular direction to be measured by inputting a sine wave having a power of 1 W thereto, while the abscissas indicate a frequency.

As described above, in the loudspeaker of the fourth example where the diaphragm reinforcing ribs are disposed being separated from each other at equal intervals, the reproduced sound pressure level is sometimes drastically varied in a high frequency band, so that the frequency characteristics are deteriorated in some cases. This is because a particular resonance mode, where the nodes of the resonance mode of the diaphragm correspond to the positions of the reinforcing ribs, is emphasized. In the loudspeaker of this fourth example, a peak appears at 7 kHz and a dip appears at 8 kHz as indicated by the frequency characteristics in FIG. 11B.

In the loudspeaker of this fifth example, the deterioration in the frequency characteristics may be reduced by disposing the diaphragm reinforcing ribs so as to be separated from each other at unequal intervals. Consequently, the peak appearing at 7 kHz in the loudspeaker of the fourth example disappears and the level of the dip appearing at 8 kHz is reduced.

EXAMPLE 6

Figure 12A:
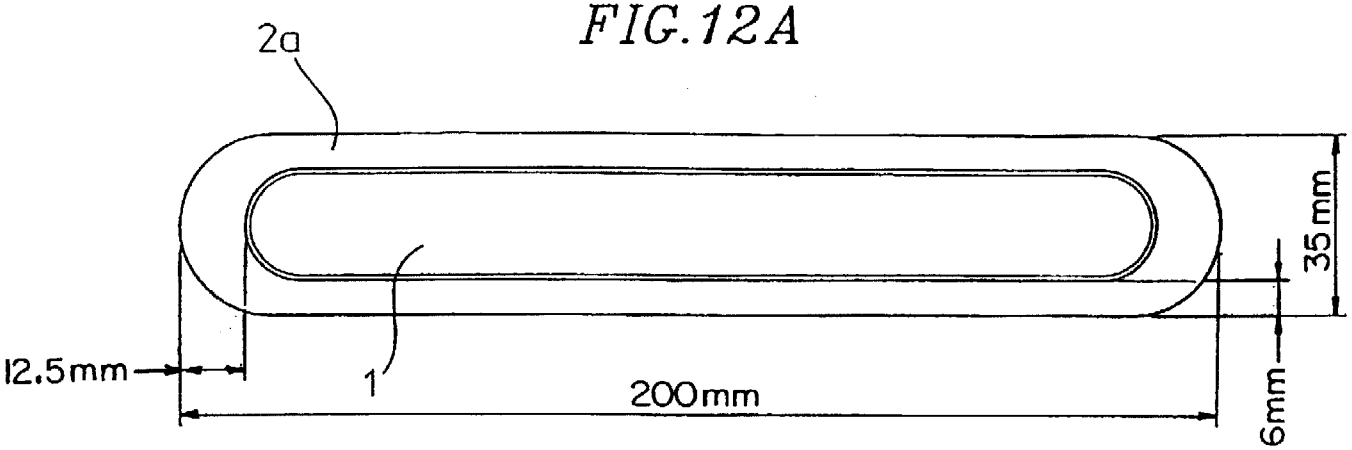
FIG. 12A is a plan view showing a diaphragm 1 and an edge 2*a* of a loudspeaker according to a sixth example of the invention.

Next, a loudspeaker according to a sixth example of the present invention will be described with reference to FIGS. 12A and 12B. FIG. 12A is a plan view showing a diaphragm 1 and an edge 2*a* of the loudspeaker of this example. The planar shape of the diaphragm 1 is non-axisymmetric having a larger diameter direction and a smaller diameter direction, and the edge 2*a* is attached around the outer periphery of the diaphragm 1. The edge 2*a* has a width of 6 mm in the linear portions, but has a larger width in the outer periphery of the diaphragm 1 where the radius of curvature becomes small. The largest width of the edge 2*a* is 12.5 mm.

Figure 12B:
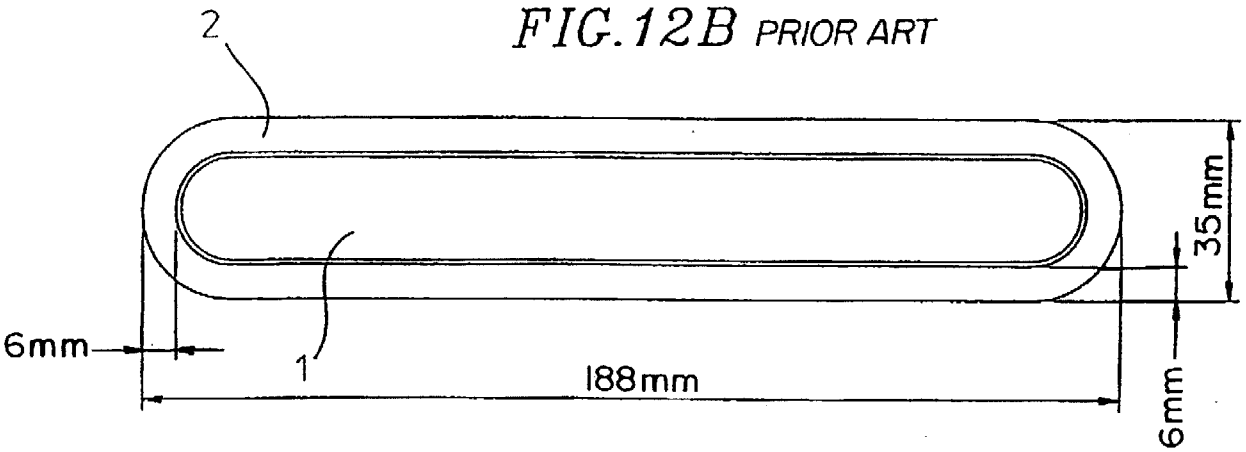
FIG. 12B PRIOR ART
FIG. 12B is a plan view showing a diaphragm 1 and an edge 2 of a conventional loudspeaker.

On the other hand, a conventional edge 2 shown in FIG. 12B has an equal width of 6 mm irrespective of the radius of curvature in the outer periphery of the diaphragm 1. In the case of using the edge 2 shown in FIG. 12B, since a force is exerted along the peripheral direction when the curvilinear portions move vertically, the rigidity increases in the curvilinear portions as compared with the linear portions. This tendency becomes more remarkable if setting the width of the edge to be smaller. For example, in the case where this edge is made of the material shown in Table 1, the rigidity of the curvilinear portion per centimeter is calculated 100 [N/m], and that of the linear portion per centimeter is calculated 36 [N/m]. Accordingly, the curvilinear portions contribute more to the increase in the rigidity of the entire edge. The rigidity is substantially in inverse proportion to the width of the edge.

Therefore, by enlarging the width of the edge only in the curvilinear portions, the rigidity of the entire edge may be reduced to a certain degree. More specifically, if setting the ratio of the edge width in the curvilinear portion to the edge width in the linear portion at the range of 2 to 3, then the rigidity in the entire edge may be suitably averaged. The rigidity of the edge shown in FIG. 12B is 1190 [N/m], whereas the rigidity of the edge of this example shown in FIG. 12A is 920 [N/m]. Consequently, it is possible to reduce the lowest resonance frequency $f_0$ of the loudspeaker by 12 percent, so that sound with improved frequency characteristics may be reproduced in an even lower sound region.

EXAMPLE 7

Figures 13A, 13B, 13C:
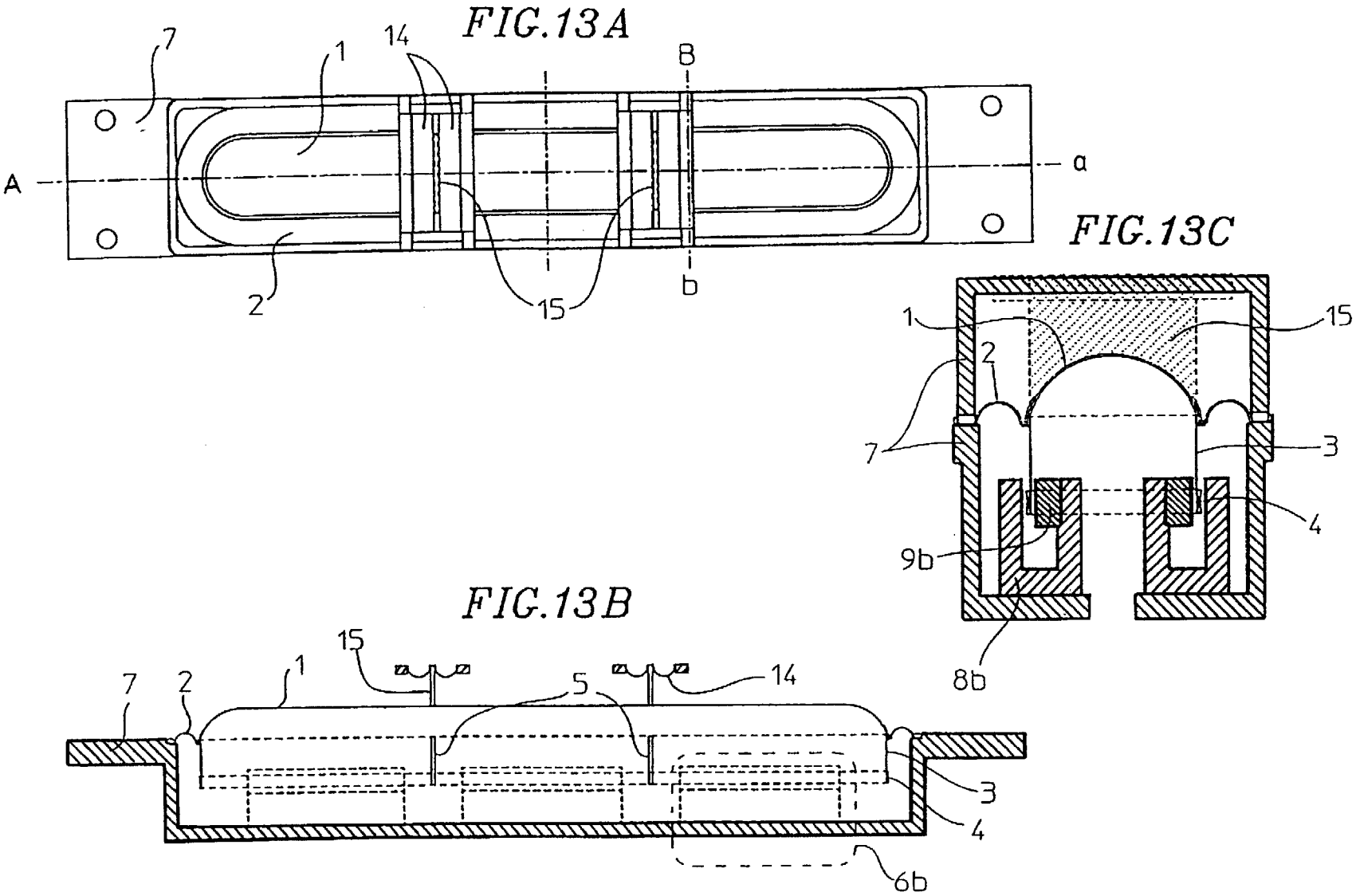
FIGS. 13A to 13C show a configuration for a loudspeaker according to a seventh example of the present invention.

Next, a loudspeaker according to a seventh example of the present invention will be described with reference to FIGS. 13A to 13C. FIGS. 13A to 13C show a configuration for a loudspeaker according to the seventh example of the present invention. FIG. 13A is a plan view; FIG. 13B is a cross-sectional view taken along the larger diameter direction; and FIG. 13C is a cross-sectional view taken along the smaller diameter direction of the loudspeaker. The same components as those of Example 3 are denoted by the same reference numerals and the description thereof will be omitted herein.

Linear dampers 14 are provided above the diaphragm 1 so as to be parallel to each other in the smaller diameter direction, and are supported by the frame 7, as shown in FIG. 13B. Diaphragm/damper connecting members 15 are provided so as to be parallel to each other in the smaller diameter direction, or the vibration direction of the diaphragm. The upper end portions of the connecting members 15 are attached to the dampers 14, and the lower end portions thereof are attached to the diaphragm 1. Accordingly, the diaphragm 1 is supported by two kinds of members, i.e., the edge 2 and the dampers 14 (via the diaphragm/damper connecting members 15).

This structure remarkably improves the stability of the diaphragm with respect to the rolling about the larger diameter direction thereof as compared with the loudspeaker of the first example, so that the rolling is not generated about the direction. Therefore, even larger maximum input power may be applied to the loudspeaker. The linear shape of the dampers may reduce the rigidity, thereby enabling the reproduction in an even lower sound region. It is noted that the number of the dampers is not limited to that used in this example.

EXAMPLE 8

Figure 14A:
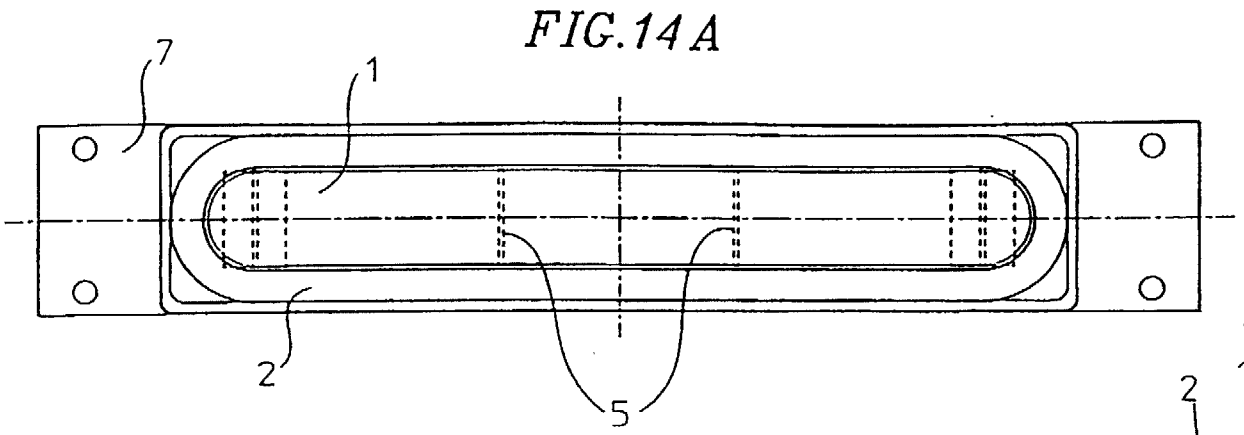
FIGS. 14A to 14C show a configuration for a loudspeaker according to an eighth example of the present invention.
Figure 14C:
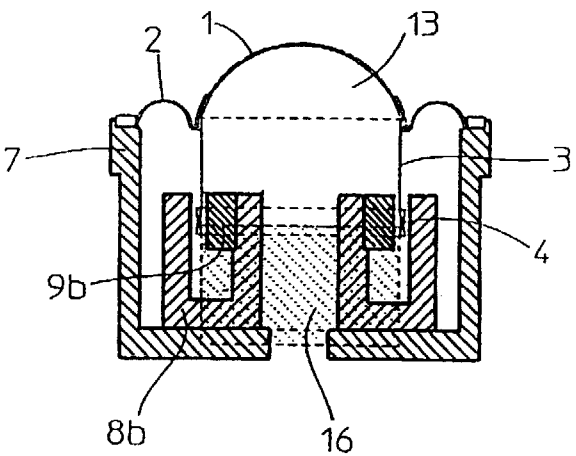
Figure 14B:
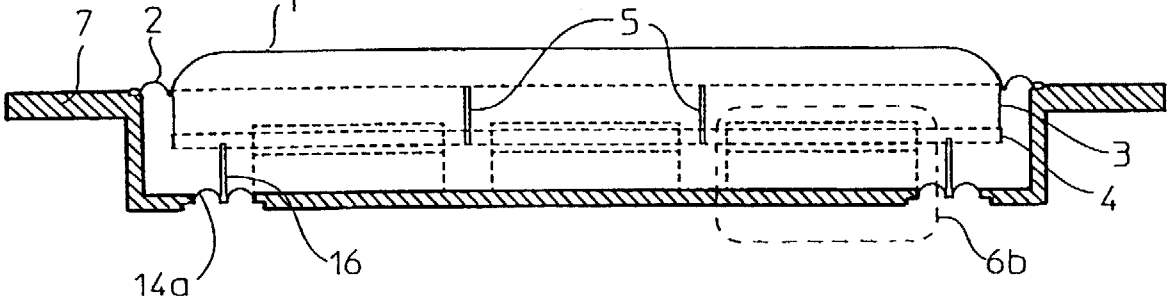

Next, a loudspeaker according to an eighth example of the present invention will be described with reference to FIGS. 14A to 14C. FIGS. 14A to 14C show a configuration of a loudspeaker according to the eighth example of the present invention. FIG. 14A is a plan view; FIG. 14B is a cross-sectional view taken along the larger diameter direction; and FIG. 14C is a cross-sectional view taken along the smaller diameter direction of the loudspeaker. The same components as those of Example 3 are denoted by the same reference numerals and the description thereof will be omitted herein.

Linear dampers 14*a* are provided below a voice coil bobbin 3 so as to be parallel to each other in the smaller diameter direction, end are supported by a frame 7, as shown in FIG. 14B. Voice coil/damper connecting members 16 are provided so as to be parallel to each other in the smaller diameter direction, or the vibration direction of the diaphragm 1. The upper end portions of the connecting members 16 are attached to the voice coil bobbin 3, and the lower end portions thereof are attached to the dampers 14*a*.

This structure realizes the same effects as those of Example 7, i.e., the improvement of the supporting characteristics of the diaphragm in the smaller diameter direction, the reduction of the rigidity of the dampers, and the like. Since the dampers for the loudspeaker of Example 7 are provided over the front surface of the diaphragm, the sound waves radiated from the front surface of the diaphragm may be diffused by the dampers, so that the frequency characteristics are possibly deteriorated in some cases. On the other hand, since the dampers are disposed on the rear side of the diaphragm in the loudspeaker of this example, such a problem does not arise. It is noted that the number of the dampers is not limited to that used in this example.

EXAMPLE 9

Figure 15:
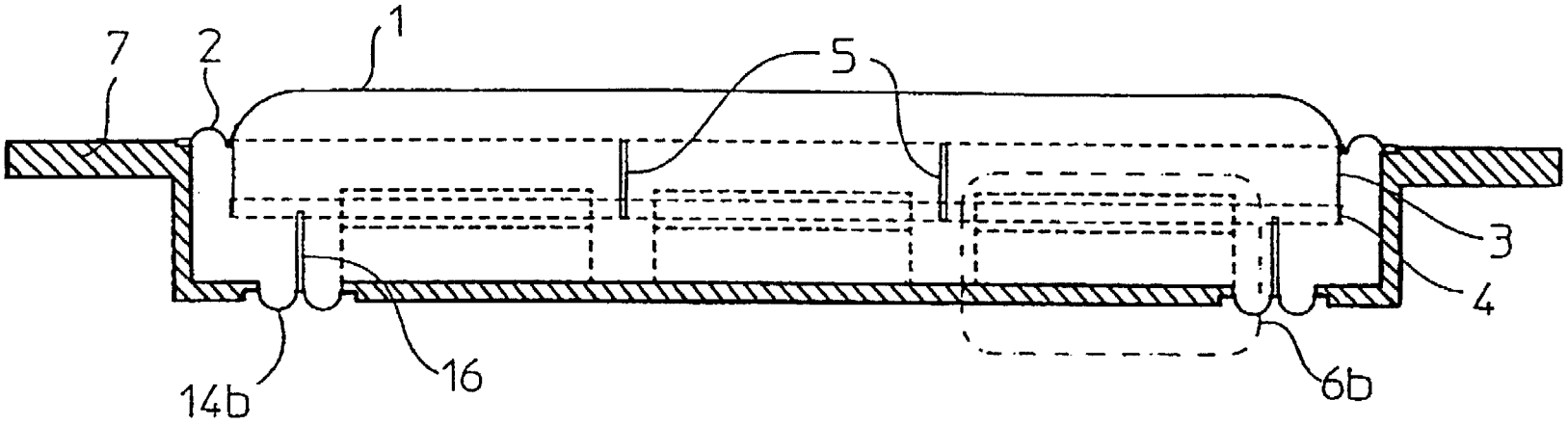
FIG. 15 is a cross-sectional view taken along the larger diameter direction of a loudspeaker according to a ninth example of the present invention.

Next, a loudspeaker according to a ninth example of the present invention will be described with reference to FIGS. 15 and 16. FIG. 15 is a cross-sectional view in the larger diameter direction of the loudspeaker according to the ninth example of the invention. The same components as those of Example 8 are denoted by the same reference numerals and the description thereof will be omitted herein.

Figure 16:
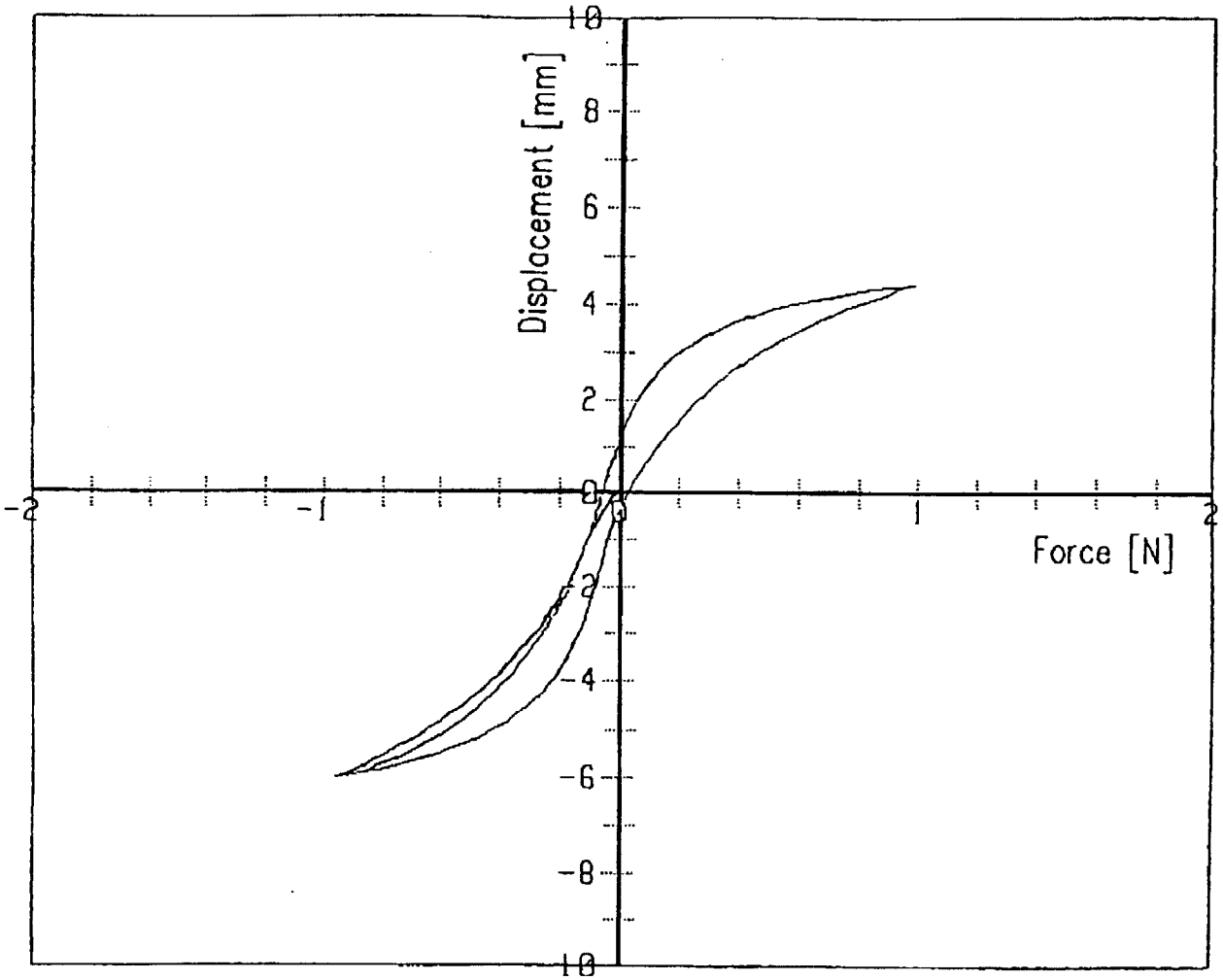
FIG. 16 is a graph showing a relationship between a force to be applied and a displacement of a linear roll-shaped edge or a linear roll-shaped damper.

FIG. 16 is a graph showing the relationship between the force to be applied and the displacement of a roll-shaped edge or a roll-shaped damper. As shown in FIG. 16, a roll-shaped edge (or damper) has a disadvantage of exhibiting poor linearity in the force displacement characteristics. This disadvantage is caused by the shape of the roll. Here, the roll-shaped edge may be classified into two Categories depending on the shape thereof. That is to say, a roll-shaped edge having a convex shape in the front surface direction of the loudspeaker (hereinafter, referred to as an "up-roll"), and a roll-shaped edge having a convex shape in the rear surface direction of the loudspeaker (hereinafter, referred to as an "down-roll"). Following this naming, in FIG. 15, the edge 2 is an up-roll, and the damper **14*b* is a down-roll. Even if the diaphragm of the loudspeaker is displaced towards the same direction, the rigidity (corresponding to an inverse number of the inclination of the curve in FIG. 16) becomes different depending on whether the edge is an up-roll or a down-roll. For example, when the diaphragm is displaced in the front surface direction of the loudspeaker, the rigidity of the up-roll edge is larger than that of the down-roll edge. In other words, the rigidity when the diaphragm is displaced towards the direction of the convex edge is larger than the rigidity when the diaphragm is displaced towards the direction of the concave edge. The non-linearity in the force-displacement characteristics as shown in FIG. 16** causes a non-linear distortion when the amplitude is large, thereby degrading the frequency characteristics of the reproduced sound in the low sound region, in particular.

In the loudspeaker of this example as shown in FIG. 15, the non-linear distortion when the amplitude is large may be reduced, thereby improving the frequency characteristics of the reproduced sound. By uslng an up-roll edge 2 and a down-roll damper **14*b***, this improvement is realized by canceling the difference in the rigidity caused by the displacement direction of the diaphragm.

EXAMPLE 10

Figure 17B:
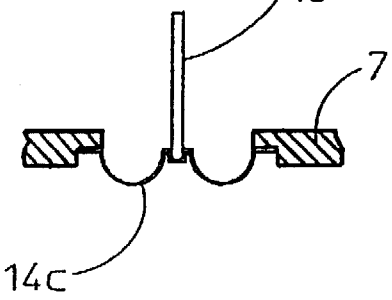
FIGS. 17A and 17B show a configuration for a damper according to a tenth example of the present invention.
Figure 17A:
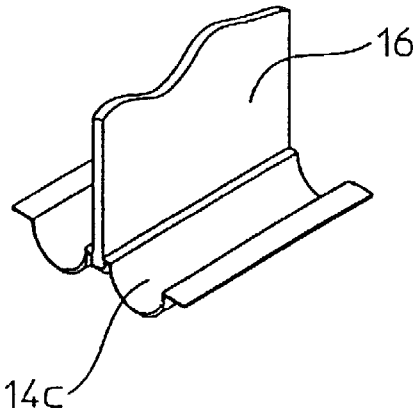

Next, a loudspeaker according to a tenth example of the present invention will be described with reference to FIGS. 17A and 17B. FIGS. 17A and 17B show a configuration of a damper according to the tenth example of the invention. FIG. 17A is a perspective view and FIG. 17B is a cross-sectional view in the smaller diameter direction of the damper of the invention. In this example, all the components are the same as those used in Example 8 except for the dampers **14*c***.

The dampers **14*c* are provided so as to be parallel to each other in the smaller diameter direction of the diaphragm 1 (not shown), and are retained by a frame 7. Each damper 14*c* includes a pair of opposed down-rolls and a concave portion provided between the pair of down-rolls. The vertical cross section along the larger diameter direction is W shaped with a U shape concave portion at the central top end thereof. A voice coil bobbin/damper connecting member 16 is joined to the damper 14*c* on the U shaped concave portion. Since the adhesive used for Joining the connecting member 16 to the concave portion of the damper 14*c* is collected in the concave portion, the adhesiveness may be improved, so that the disjunction between the damper 14*c* and the voice coil bobbin/damper connecting member 16** may be prevented.

EXAMPLE 11

Figure 18:
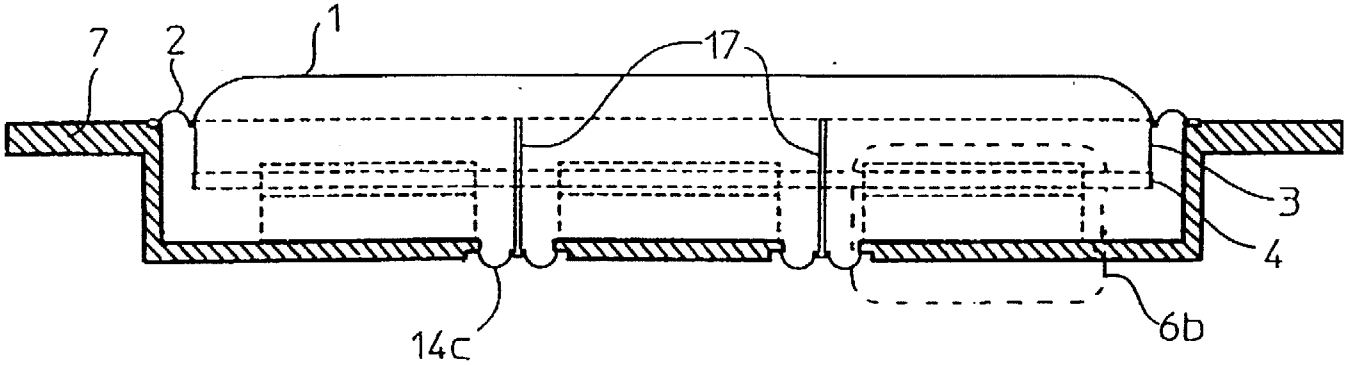
FIG. 18 is a cross-sectional view taken along the larger diameter direction of a loudspeaker according to an eleventh example of the present invention.

Next, a loudspeaker according to an eleventh example of the present invention will be described with reference to FIG. 18. FIG. 18 is a cross-sectional view in the larger diameter direction of the loudspeaker according to the eleventh example of the invention. The same components as those of Example 10 are denoted by the same reference numerals and the description thereof will be omitted herein.

Connecting members 17 of this example performs the functions of the voice coil/damper connecting member of Example 8 and the bobbin reinforcing member of Example 1. By using these members 17, the effects obtained in both examples may be attained at the same time and the number of the components to be used and the adhesion points may be reduced, thereby improving the reproductivity and reducing the weight of the vibration system. Consequently, sound with improved frequency characteristics may be reproduced from the loudspeaker more effectively.

EXAMPLE 12

Figure 19:
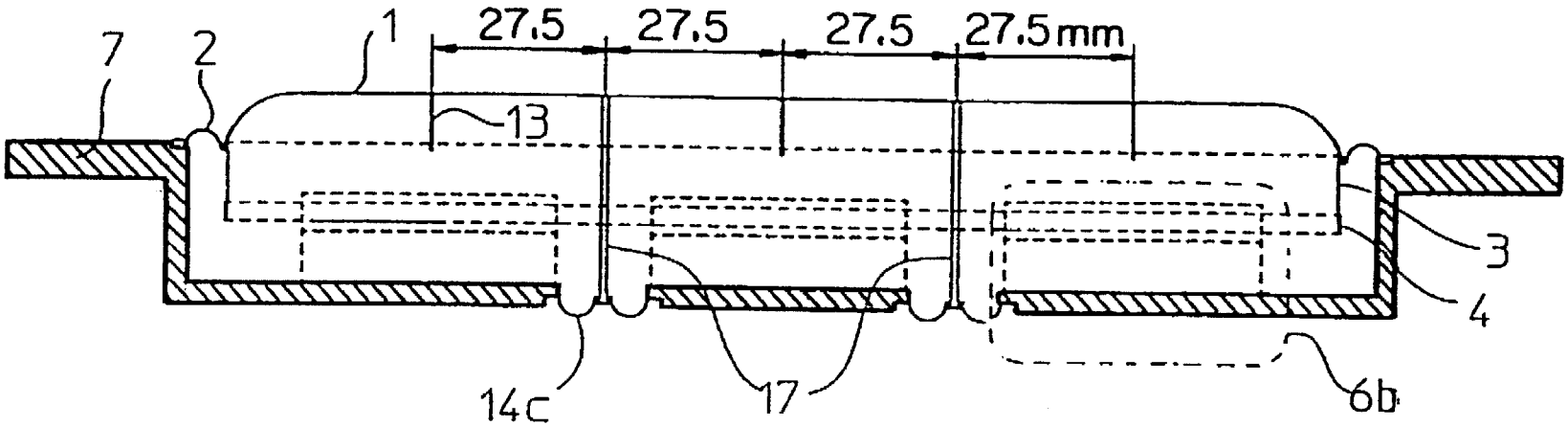
FIG. 19 is a cross-sectional view taken along the larger diameter direction of a loudspeaker according to a twelfth example of the present invention.

Next, a loudspeaker according to a twelfth example of the present invention will be described with reference to FIG. 19. FIG. 19 is a cross-sectional view in the larger diameter direction of the loudspeaker according to the twelfth example of the invention. The same components as those of Example 11 are denoted by the same reference numerals and the description thereof will be omitted herein.

In the loudspeaker of this example, diaphragm reinforcing ribs 13 are attached to the reverse side of the diaphragm 1 of the loudspeaker of Example 11, so that the effects obtained in Example 4 may also be attained in this example. The diaphragm reinforcing ribs 13 are D shaped thin plates made of paper. Five diaphragm reinforcing ribs 13 are disposed being separated from each other at equal intervals along the larger diameter direction of the diaphragm 1 so as to be attached to the reverse side of the diaphragm 1 along the smaller diameter direction. It is noted that the number and the material of the diaphragm reinforcing ribs 13 are not limited to those defined in this example.

EXAMPLE 13

Figure 20:
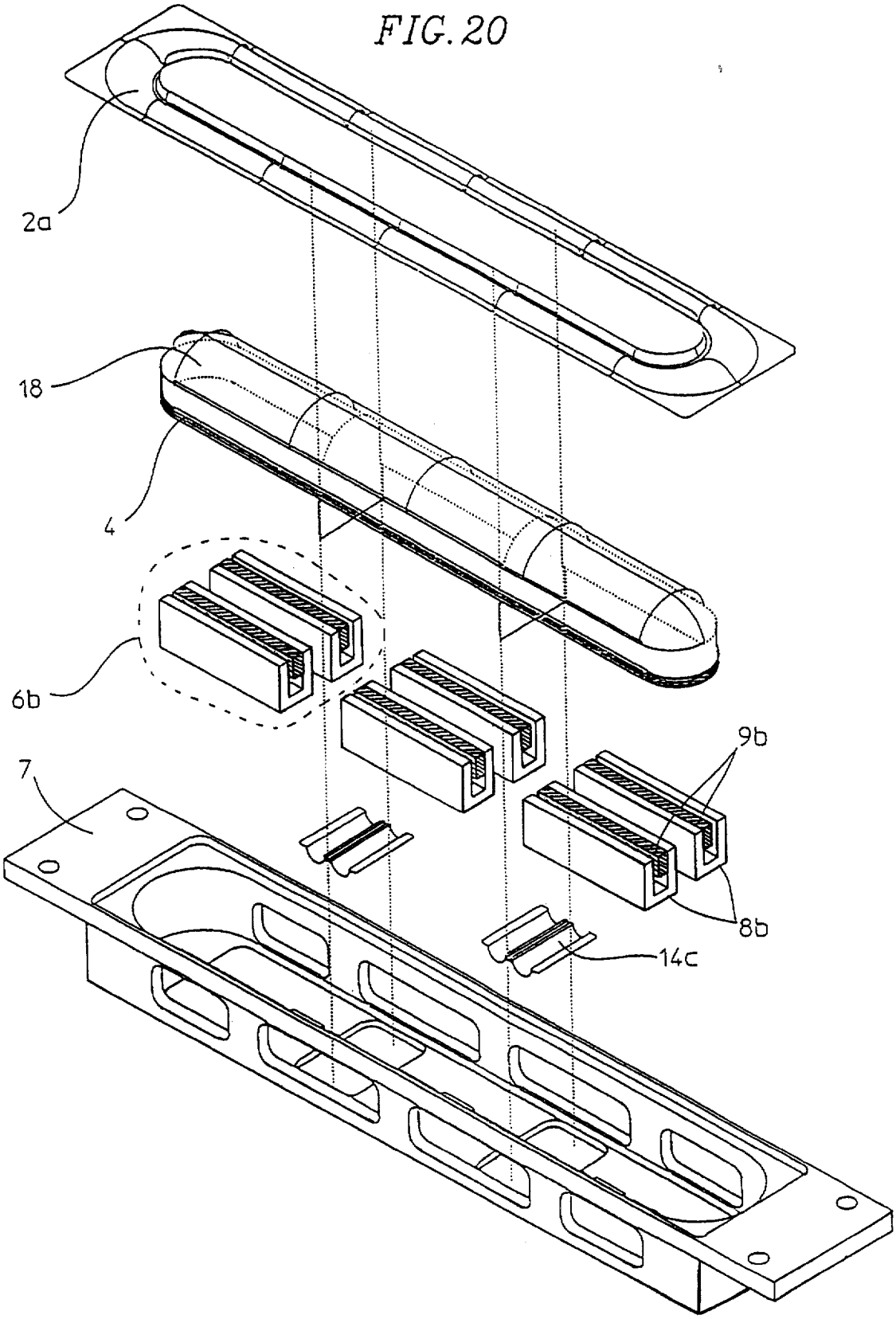
FIG. 20 is an exploded perspective view of the respective components to be assembled for a loudspeaker according to a thirteenth example of the present invention.

Next, a loudspeaker according to a thirteenth example of the present invention will be described with reference to FIG. 20. FIG. 20 is an exploded perspective view of the respective components to be assembled of the loudspeaker according to the thirteenth example of the invention. An edge **2*a* of this example is the same as the edge 2*a*** of the loudspeaker of the sixth example. The same components as those of Example 12 are denoted by the same reference numerals and the description thereof will be omitted herein.

The loudspeaker of this example uses a member functioning as the diaphragm, the voice coil bobbin, the connecting member and the diaphragm reinforcing rib to be obtained by integrally forming these members. All the components except for this integrated member are the same as those of Example 11. The member 18 functioning as the diaphragm, the bobbin and the connecting member integrally formed using a material such as polymethyl pentene and a nylon-based composite material. In a loudspeaker having such a configuration, the number of the adhesion points is reduced and the reproductivity is improved as compared with the loudspeaker of Example 12.

EXAMPLE 14

Figure 21:
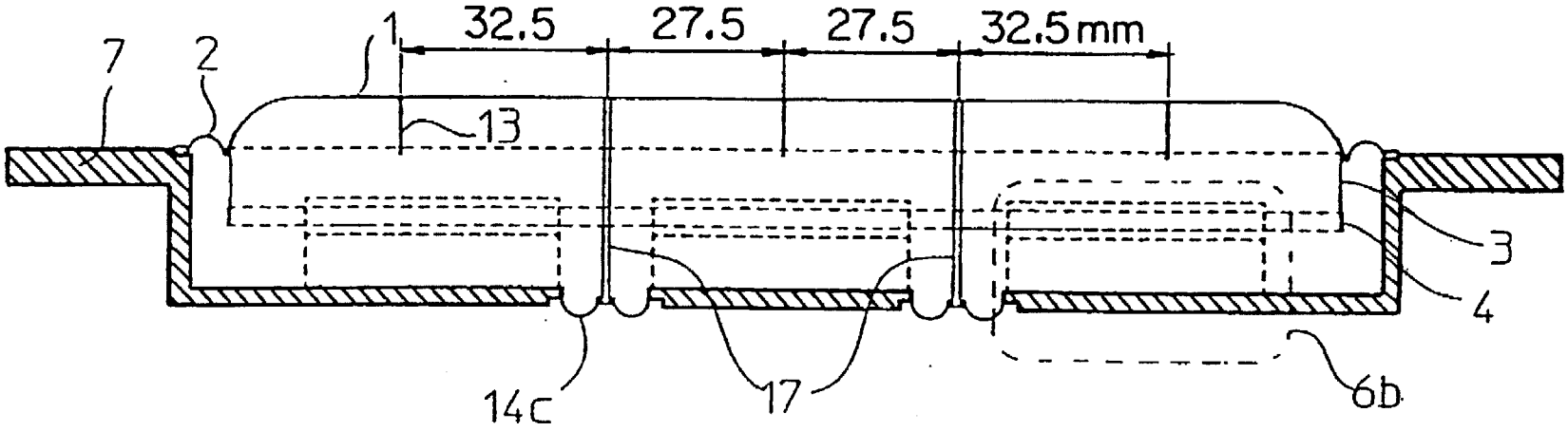
FIG. 21 is a cross-sectional view taken along the larger diameter direction of a loudspeaker according to a fourteenth example of the present invention.

Finally, a loudspeaker according to a fourteenth example of the present invention will be described with reference to FIG. 21. FIG. 21 is a cross-sectional view in the larger diameter direction of the loudspeaker according to the fourteenth example of the invention. The same components as those of Example 11 are denoted by the same reference numerals and the description thereof will be omitted herein.

In the loudspeaker of this example, the diaphragm reinforcing ribs 13 are attached to the reverse side of the diaphragm of the loudspeaker of Example 11 so as to be separated from each other at unequal intervals. As a result, the effects obtained in Example 5 may also be attained in this example.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A loudspeaker comprising:

a frame;

a diaphragm, a planar shape thereof being non-axisymmetric having a larger diameter and a smaller diameter when the diaphragm is viewed from a vibration direction thereof;

a band-shaped edge portion provided around an outer periphery of the diaphragm, the outer periphery of the edge portion being connected to the frame and an inner periphery of the edge portion being connected to the diaphragm;

a cylindrical voice coil bobbin in a non-axisymmetric shape having a larger diameter and a smaller diameter which includes a pair of opposed faces parallel to each other in a larger diameter direction, one end portion of the voice coil bobbin being connected to the diaphragm;

a voice coil wound around the voice coil bobbin;

a plurality of voice coil bobbin reinforcing members in a plate shape which are bridged between the pair of opposed faces parallel to each other of the voice coil bobbin; and a plurality of magnetic circuits having a gap for applying magnetic fluxes to at least a part of the voice coil.

2. A loudspeaker according to claim 1 wherein each of the plurality of magnetic circuits comprises: a yoke having a U-shaped cross section; a first magnet fixed inside the yoke; a plate which is fixed on an upper surface of the first magnet and is opposed to internal side faces of the yoke via gaps; and a second magnet fixed on an upper surface of the plate, and wherein a magnetization direction of the first magnet is opposite to a magnetization direction of the second magnet.

3. A loudspeaker according to claim 1 wherein each of the plurality of magnetic circuits comprises a pair of yokes, each of the yokes having a U-shaped cross section; each of the pair of yokes comprises a magnet fixed on an internal face thereof; and a gap is provided between the pair of yokes.

4. A loudspeaker according to claim 1 wherein the diaphragm is projected towards a sound radiating direction of the loudspeaker and comprises at least one of reinforcing member connected to an internal face of the diaphragm.

5. A loudspeaker according to claim 4 wherein a number of the at least one reinforcing members of the diaphragm is at least three and the at least three reinforcing members of the diaphragm are disposed in the larger diameter direction of the diaphragm so as to be separated at unequal intervals.

6. A loudspeaker according to claim 1 wherein a width of curvilinear portions of the edge portion is larger than a width of linear portions of the edge portion.

7. A loudspeaker according to claim 1 further comprising:

a diaphragm/damper connecting member provided on a sound radiating side of the loudspeaker with respect to the diaphragm, one end portion of the diaphragm/damper connecting member being connected to the diaphragm; and a damper member connected to the other end portion of the diaphragm/damper connecting member which support the diaphragm so as to allow the diaphragm to vibrate freely by connecting the damper member to the frame.

8. A loudspeaker according to claim 1 wherein a ratio of a larger diameter of the diaphragm to a smaller diameter thereof is equal to or larger than 6.

9. A loudspeaker according to claim 1 wherein a ratio of a width of the curvilinear portions of the edge portion in the larger diameter direction to a width of the linear portions of the edge portion in the smaller diameter direction is in a range of 2 to 3.

10. A loudspeaker according to claim 1, wherein the plurality of voice coil reinforcing members are substantially perpendicular to an opening surface of the cylindrical voice coil bobbin.

11. A loudspeaker according to claim 1, wherein at least one of the voice coil reinforcing members is interposed between adjacent ones of the plurality of magnetic circuits.

12. A loudspeaker according to claim 1, wherein the voice coil reinforcing members serve to prevent the generation of higher harmonic resonance in the voice coil bobbin.

13. A loudspeaker comprising:

a frame;

a diaphragm, a planar shape thereof being non-axisymmetric having larger diameter and a smaller diameter when the diaphragm is viewed from vibration direction thereof;

a band-shaped edge portion provided around an outer periphery of the diaphragm, the outer periphery of the edge portion being connected to the frame and an inner periphery of the edge portion being connected to the diaphragm;

a cylindrical voice coil bobbin in a non-axisymmetric shape having a larger diameter and a smaller diameter which includes a pair of opposed faces parallel to each other in a larger diameter direction, one end portion of the voice coil bobbin being connected to the diaphragm;

a voice coil wound around the voice coil bobbin;

a plurality of voice coil bobbin reinforcing members in a plate shape which are bridged between the pair of opposed faces parallel to each other of the voice coil bobbin;

a plurality of magnetic circuits having a gap for applying magnetic fluxes to at least a part of the voice coil;

a plate-shaped voice coil bobbin/damper connecting member provided on an opposite side to a sound radiating side of the loudspeaker with respect to the diaphragm, one end portion of the voice coil bobbin/damper connecting member being connected to the voice coil bobbin; and a damper member having a pair of semi-cylindrical portions connected to each other by interposing the other end of the voice coil bobbin/damper connecting member which supports the diaphragm so as to allow the diaphragm to vibrate freely by connecting the damper member to the frame.

14. A loudspeaker according to claim 13, wherein the edge portion projects in an opposite direction to a projecting direction of the damper member.

15. A loudspeaker according to claim 13, wherein the damper member comprises a concave portion provided between the pair of semi-cylindrical portions and the voice coil bobbin/damper connecting member is connected to the damper member at the concave portion.

16. A loudspeaker according to claim 13, wherein the voice coil bobbin/damper connecting member is further connected to an internal face of the diaphragm.

17. A loudspeaker according to claim 16 wherein the diaphragm projects towards the sound radiating side and comprises at least one reinforcing member connected to an internal face of the diaphragm.

18. A loudspeaker according to claim 17 wherein the diaphragm, the voice coil bobbin, the voice coil bobbin/damper connecting member and the reinforcing member of the diaphragm are integrally formed using a resin material.

19. A loudspeaker according to claim 17 wherein a number of the at least one reinforcing member of the diaphragm is at least three, and the at least three reinforcing members of the diaphragm are disposed so as to be separated at unequal intervals.

* * * * *